US012140034B2

(12) United States Patent
Yamarthi et al.

(10) Patent No.: US 12,140,034 B2
(45) Date of Patent: Nov. 12, 2024

(54) TURBINE ENGINE WITH A ROTOR SEAL RETRACTION MECHANISM

(71) Applicant: General Electric Company, Schenectady, NY (US)

(72) Inventors: David Yamarthi, Bengaluru (IN); Prateek Jalan, Bengaluru (IN); Grant Portune, Cincinnati, OH (US); Steven Douglas Johnson, Milford, OH (US); Mark L. Hopper, West Chester, OH (US); Richard A. Wesling, Cincinnati, OH (US); Ravindra Shankar Ganiger, Bengaluru (IN)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 18/315,736

(22) Filed: May 11, 2023

(65) Prior Publication Data

US 2024/0133308 A1 Apr. 25, 2024
US 2024/0229665 A9 Jul. 11, 2024

(30) Foreign Application Priority Data

Oct. 20, 2022 (IN) ..... 202211060006

(51) Int. Cl.
*F01D 11/02* (2006.01)
*F01D 11/00* (2006.01)

(52) U.S. Cl.
CPC ..... *F01D 11/001* (2013.01); *F01D 11/025* (2013.01)

(58) Field of Classification Search
CPC ..... F01D 11/001; F01D 11/025
See application file for complete search history.

(56) References Cited

U.S. PATENT DOCUMENTS 5,388,843 A 2/1995 Sedy
7,079,957 B2 7/2006 Finnigan et al.
7,367,776 B2 5/2008 Albers et al.
7,435,049 B2 * 10/2008 Ghasripoor ..... F01D 11/14 415/173.3
8,052,380 B2 11/2011 Willett, Jr.
(Continued)

FOREIGN PATENT DOCUMENTS

FR 3042555 B1 4/2018
WO 2008134142 A1 11/2008

OTHER PUBLICATIONS

Guijarro Valencia et al., U.S. Appl. No. 17/691,380, filed Mar. 10, 2022.

*Primary Examiner* — Sabbir Hasan
(74) *Attorney, Agent, or Firm* — Venable LLP; David D. Leege; Michele V. Frank

(57) ABSTRACT

A rotary machine, such as a turbomachine of a gas turbine engine, for example, including a rotor and a rotor seal assembly. The rotor is rotatable about a rotational axis and has a rotor seal face. The rotor seal assembly includes a seal body, one or more primary fluid conduits formed in the seal body, and a retraction assembly. The seal body has a seal face and is positionable to form a fluid-bearing gap between the seal face of the seal body and the rotor seal face. The one or more primary fluid conduits are fluidly connected to the fluid-bearing gap to supply a fluid to the fluid-bearing gap. The retraction assembly is connected to the seal body to move the seal body in a retraction direction away from the rotor seal face.

20 Claims, 15 Drawing Sheets

(56) References Cited

U.S. PATENT DOCUMENTS

| | | | | |
|---|---|---|---|---|
| 8,177,476 | B2 | 5/2012 | Andrew et al. | |
| 8,678,742 | B2 | 3/2014 | Klingels | |
| 9,963,988 | B2 | 5/2018 | Swedowicz et al. | |
| 10,962,118 | B2 | 3/2021 | Duffy et al. | |
| 2012/0248704 | A1* | 10/2012 | Fennell | F01D 11/10 277/358 |
| 2022/0389825 | A1 | 12/2022 | Johnson et al. | |

* cited by examiner

TURBINE ENGINE WITH A ROTOR SEAL RETRACTION MECHANISM

CROSS REFERENCE TO RELATED APPLICATIONS

The present application claims the benefit of Indian Patent Application No. 202211060006, filed on Oct. 20, 2022, which is hereby incorporated by reference herein in its entirety.

TECHNICAL FIELD

The present disclosure relates to rotor seals, particularly, rotor seals used in rotary machines, such as, those used in gas turbine engines for aircraft.

BACKGROUND

Gas turbine engines, particularly those used in aircraft, are rotary engines having a turbomachine where working air serially flows through a compressor section, a combustor section, and a turbine section. The working air is compressed in the compressor section. The compressed working air is then mixed with fuel and combusted in the combustor section, generating combustion products. The combustion products are then used to drive turbines of the turbine section. The compressor section and the turbine section may each include a plurality of stages. Each compressor stage and turbine stage may have axially arranged pairs of rotating blades and stationary vanes. The turbomachine includes at least one shaft connecting, for example, turbine blades with compressor blades such that rotation of the turbine blades drives the rotation of the compressor blades during operation. Seal assemblies may be used in the turbomachine between rotating components, such as the shaft, and stationary components, such as the vanes, to reduce the leakage of fluids, such as air between the rotating components and stationary components.

BRIEF DESCRIPTION OF THE DRAWINGS

Features and advantages of the present disclosure will be apparent from the following description of various exemplary embodiments, as illustrated in the accompanying drawings, wherein like reference numbers generally indicate identical, functionally similar, and/or structurally similar elements.

Figure 5:
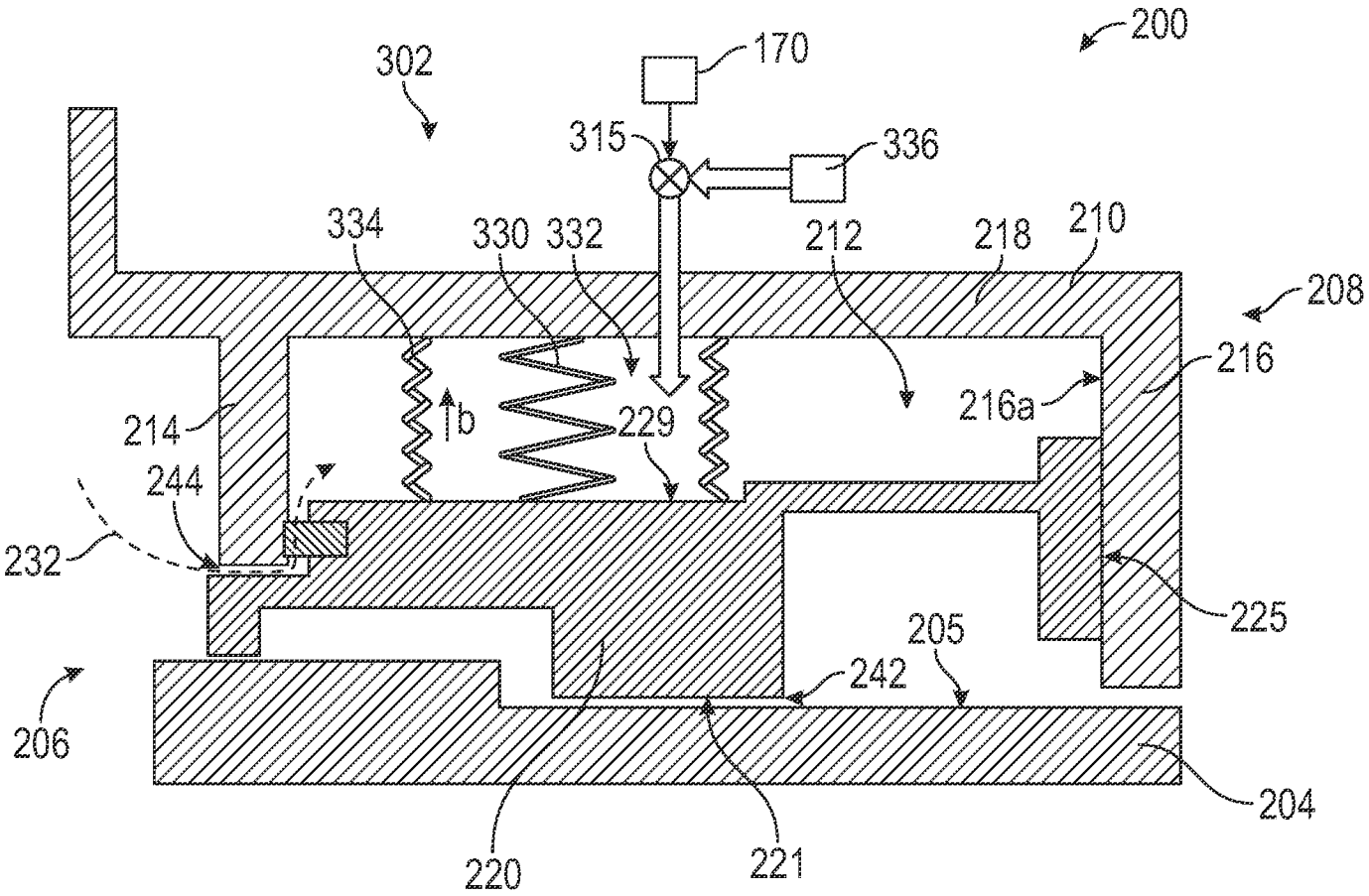
FIG. 5 is a schematic cross-sectional view of the rotor seal assembly including a retraction assembly according to another embodiment.

FIG. is 6 a perspective, cut-away view a seal body and retraction assembly of the embodiment shown in FIG. 5.

Figure 7:
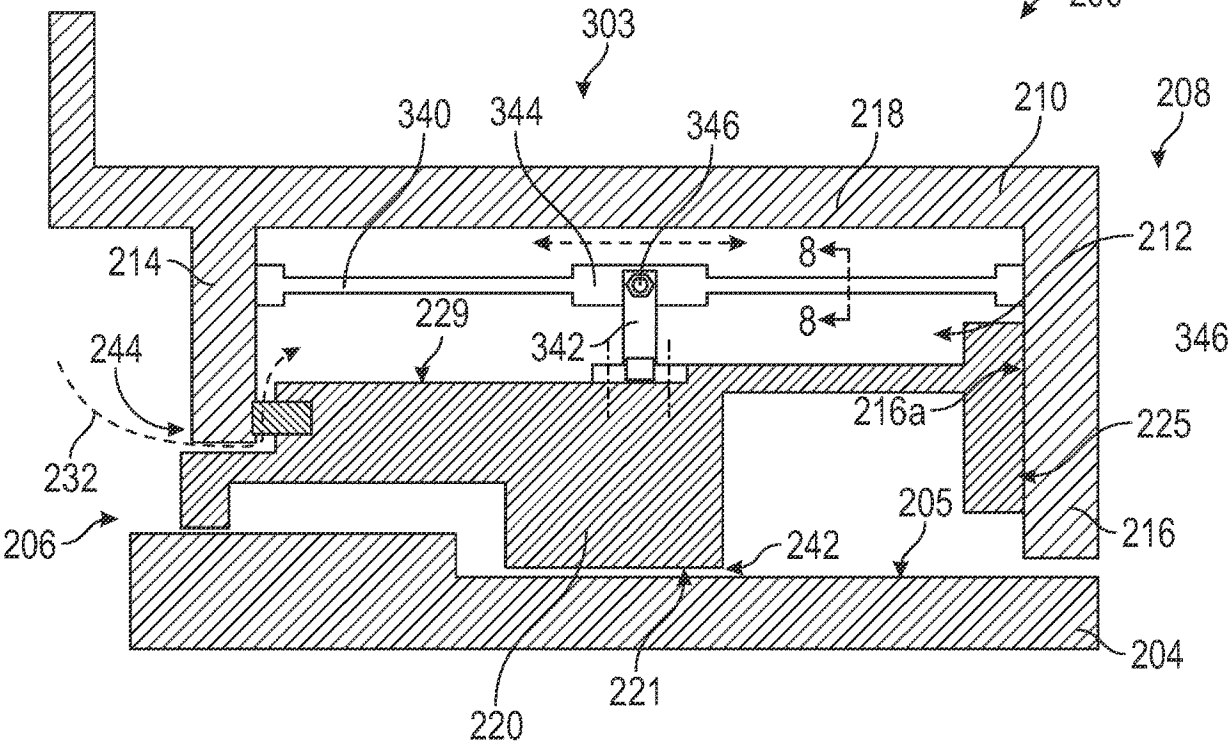

FIG. 7 is a schematic cross-sectional view of the rotor seal assembly including a retraction assembly according to another embodiment.

Figure 8:
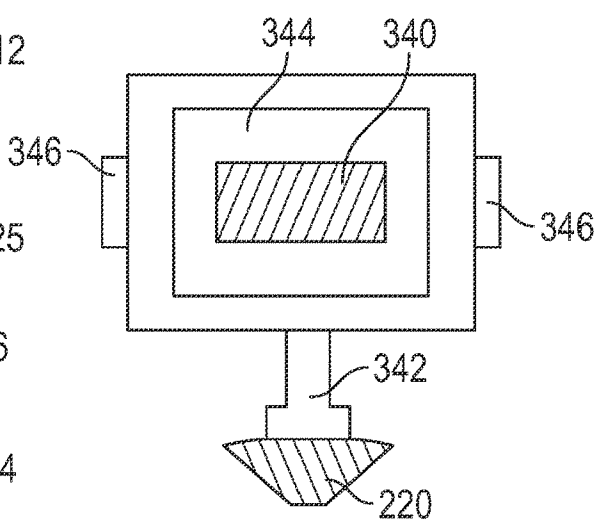

FIG. 8 is a cross-sectional view, taken along line 8-8 in FIG. 7, of the retraction assembly shown in FIG. 7.

Figure 9:
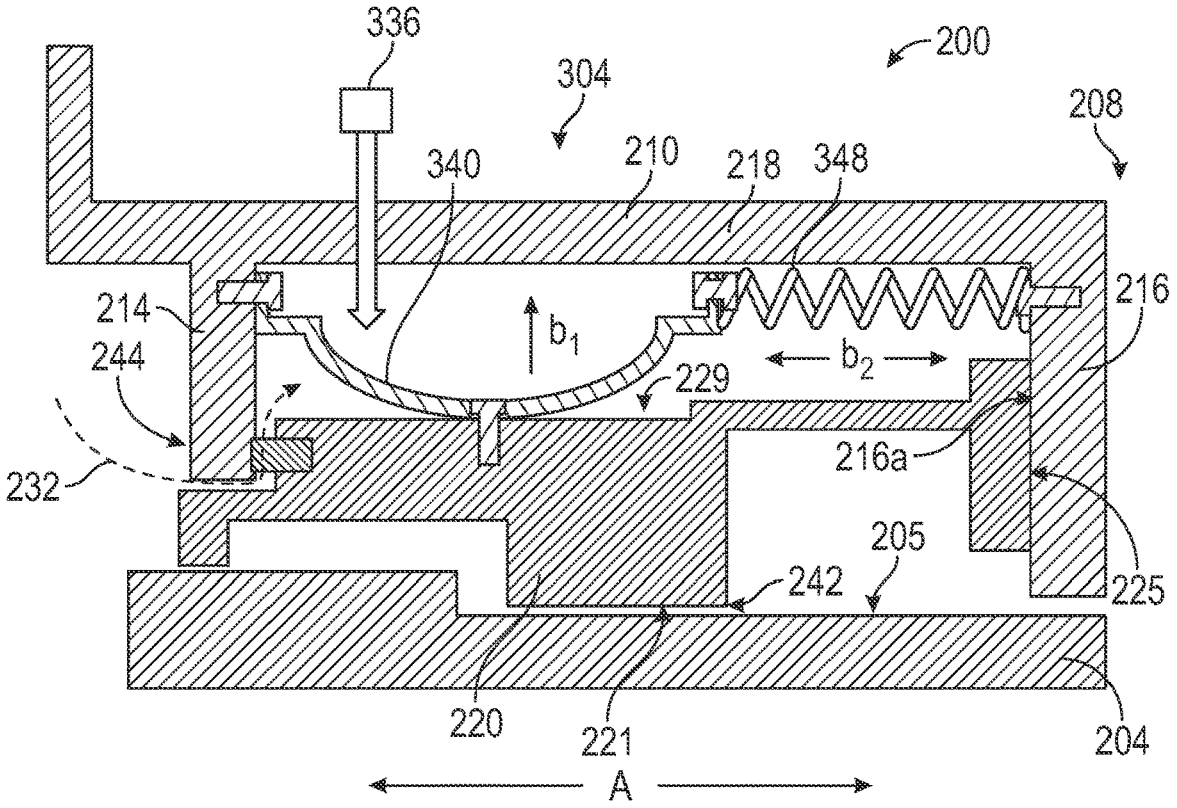

FIG. 9 is a schematic cross-sectional view of the rotor seal assembly including a retraction assembly according to another embodiment.

Figure 10:
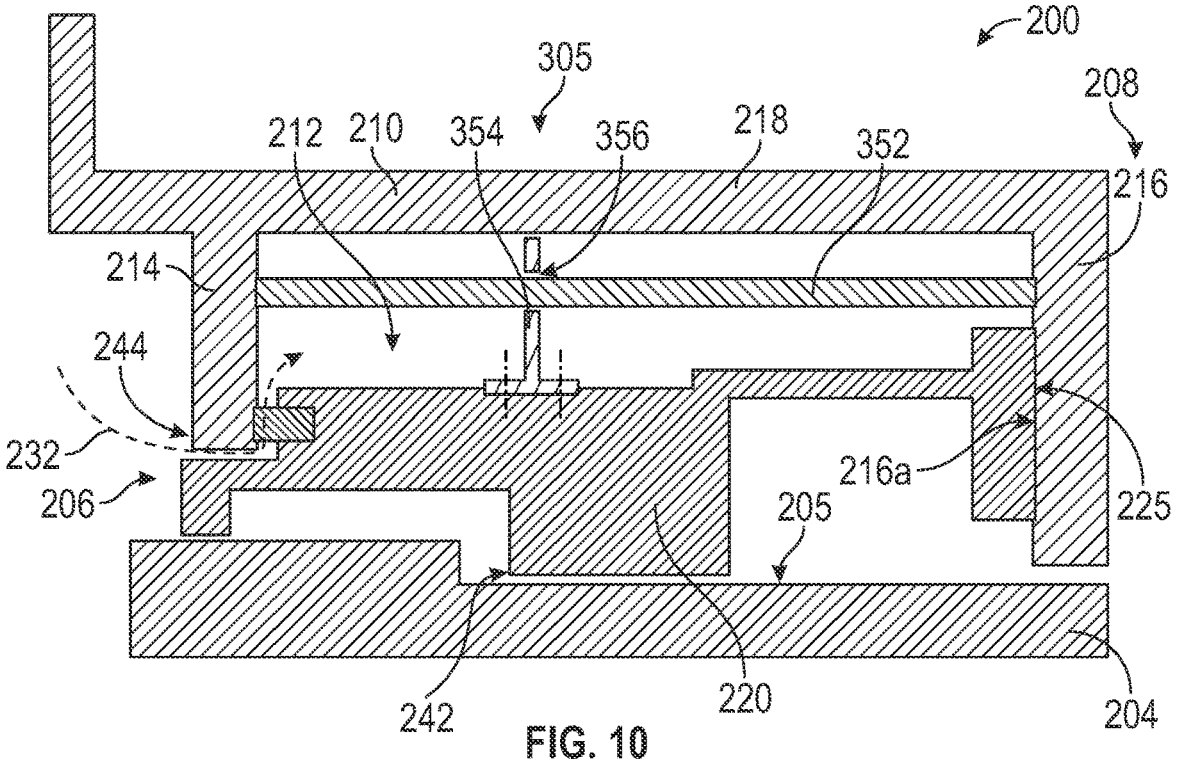

FIG. 10 is a schematic cross-sectional view of the rotor seal assembly including a retraction assembly according to another embodiment.

Figure 11:
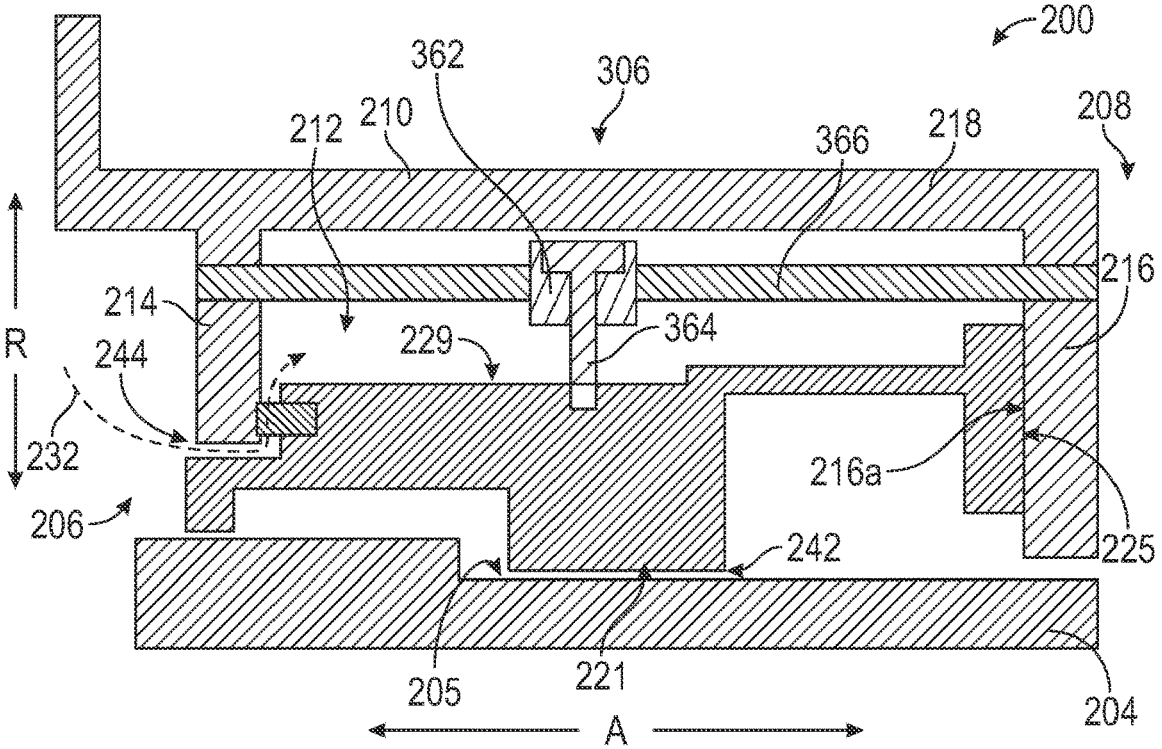

FIG. 11 is a schematic cross-sectional view of the rotor seal assembly including a retraction assembly according to another embodiment.

Figure 12:
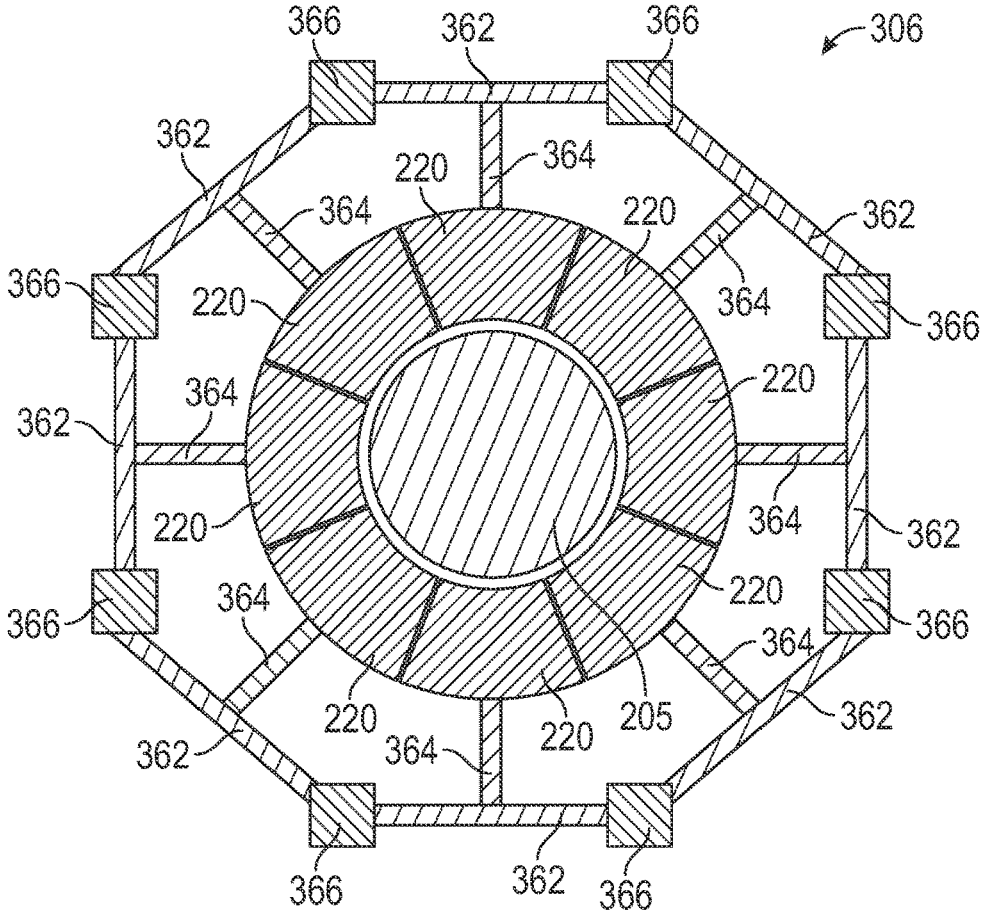

FIG. 12 is an axial cross-sectional view of the rotor with the seal housing omitted to illustrate features of the retraction assembly shown in FIG. 11.

Figure 13:
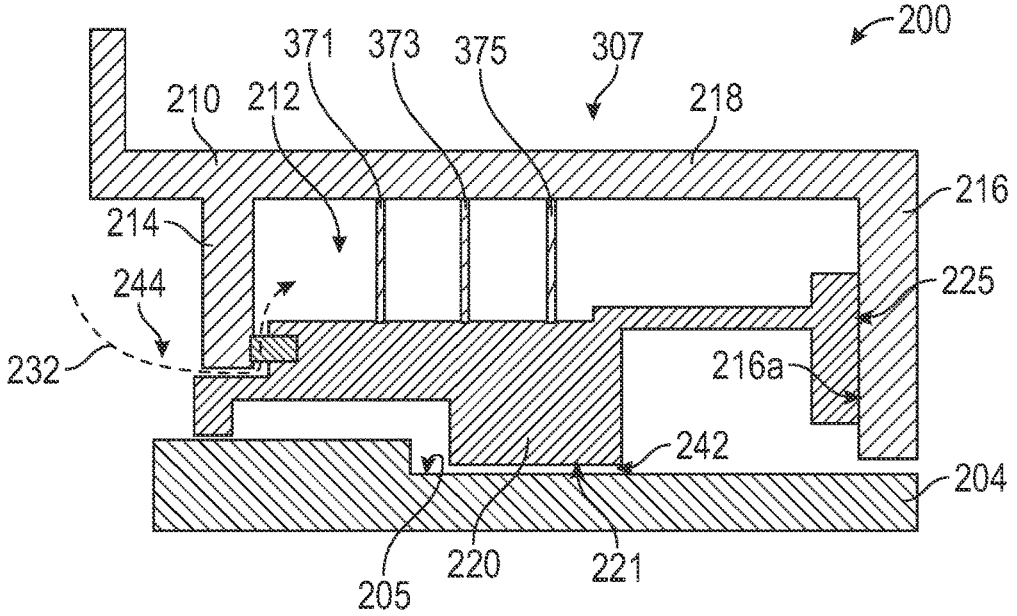

FIG. 13 is a schematic cross-sectional view of the rotor seal assembly including a retraction assembly according to another embodiment.

Figure 14:
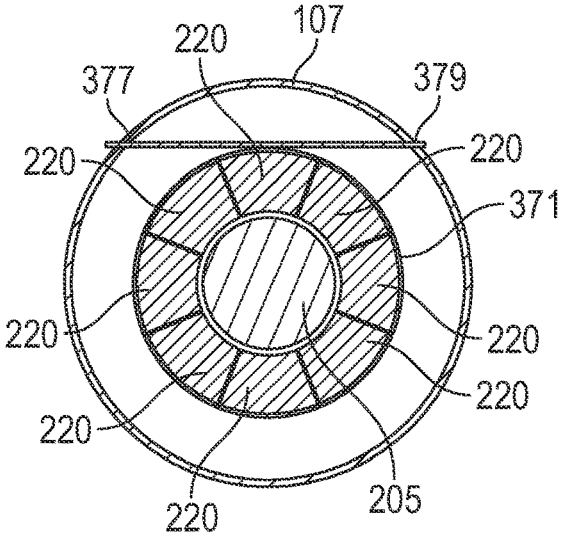

FIG. 14 is an axial cross-sectional view of the rotor showing the anchor points of a first garter spring of the retraction assembly shown in FIG. 13.

Figure 15:
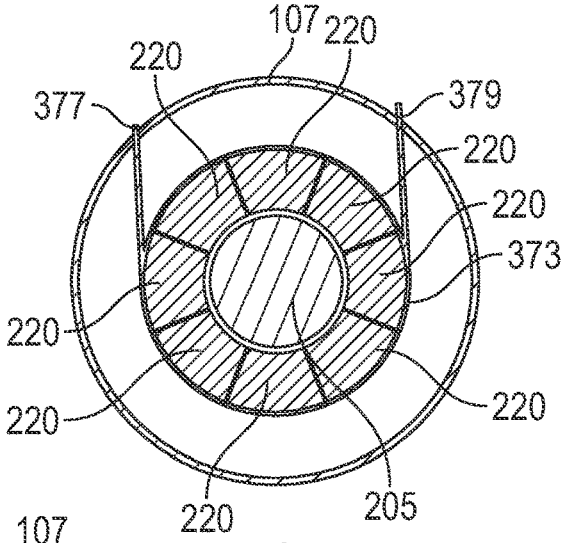

FIG. 15 is an axial cross-sectional view of the rotor showing the anchor points of a second garter spring of the retraction assembly shown in FIG. 13.

Figure 16:
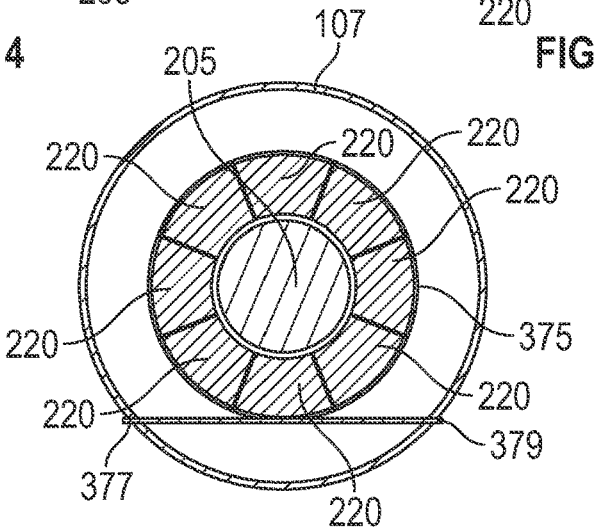

FIG. 16 is an axial cross-sectional view of the rotor showing the anchor points of a third garter spring of the retraction assembly shown in FIG. 13.

Figure 17:
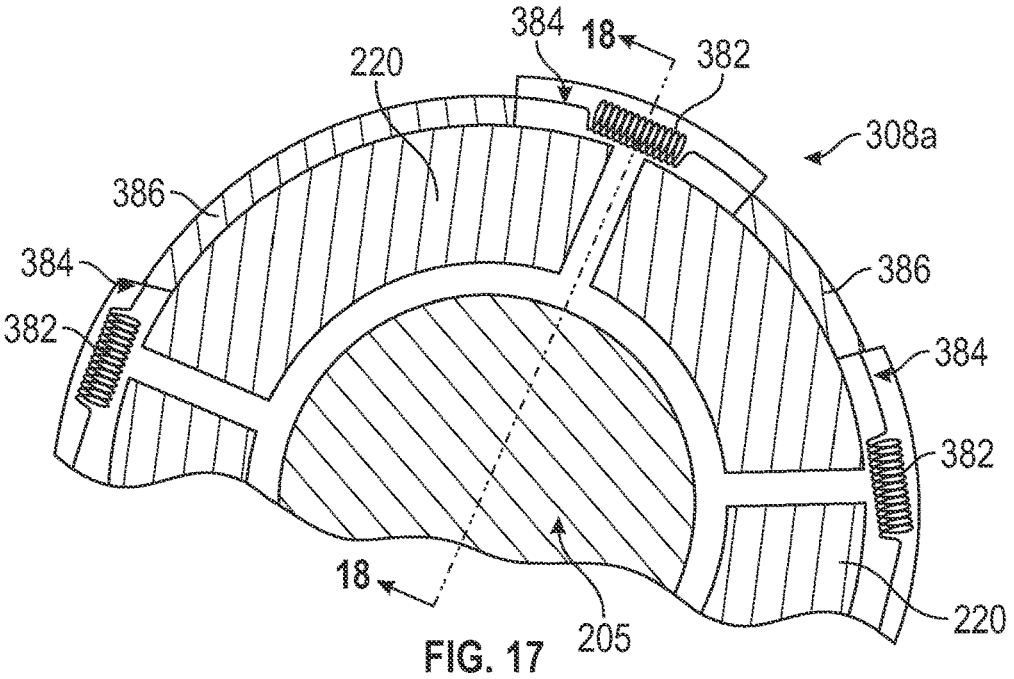

FIG. 17 is a partial axial view of the seal body and a retraction assembly according to another embodiment.

Figure 18:
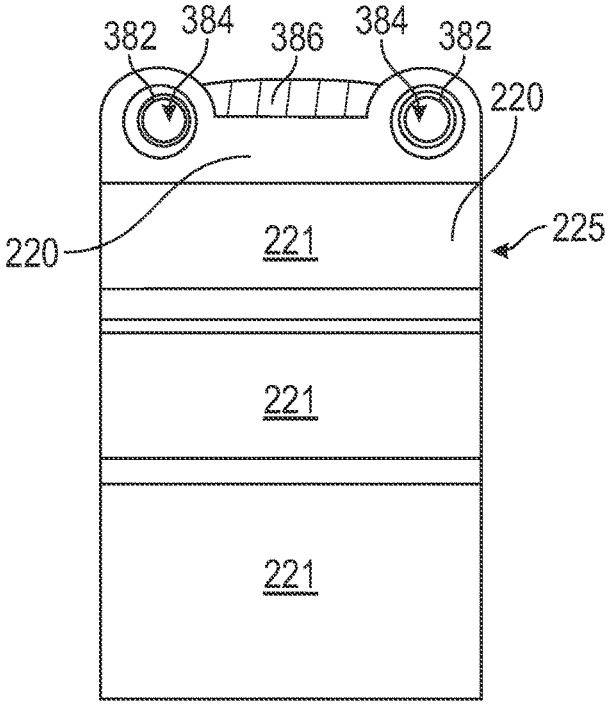

FIG. 18 is a cross-sectional view, taken along line 18-18 in FIG. 17, of the retraction assembly shown in FIG. 17.

Figure 19A:
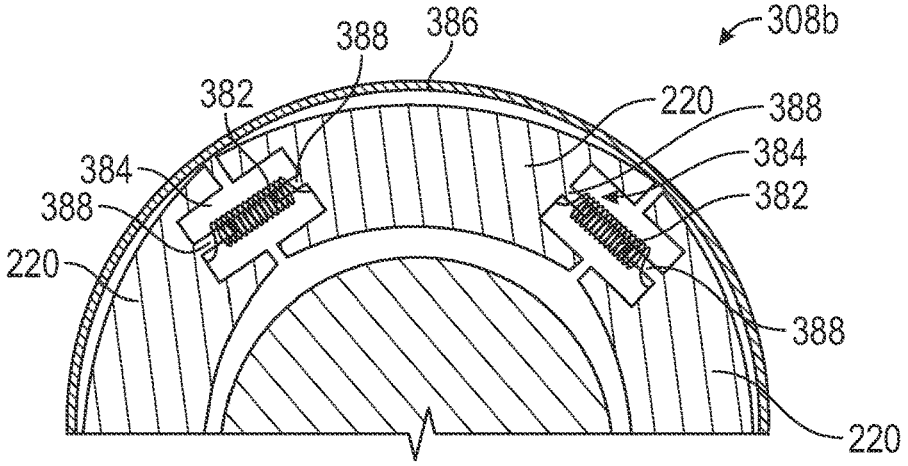

FIG. 19A is an axial view of the seal body and a retraction assembly according to another embodiment for the rotor seal assembly.

Figure 19B:
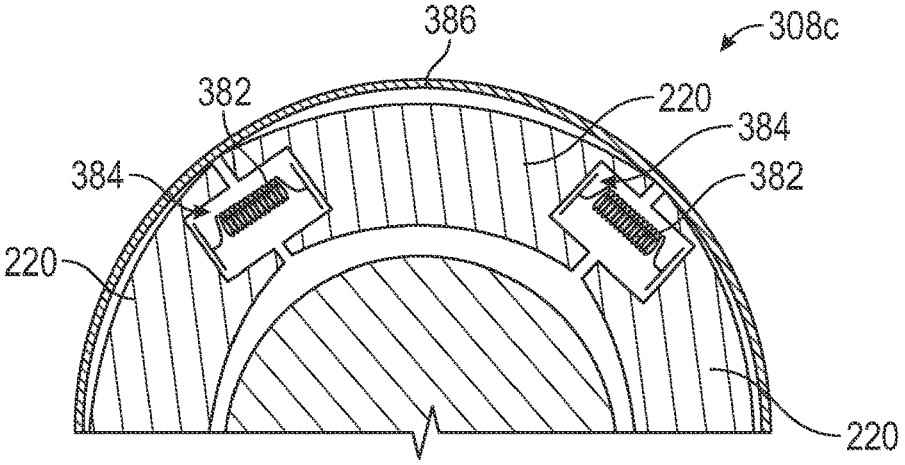

FIG. 19B is an axial view of the seal body and a retraction assembly according to another embodiment for the rotor seal assembly.

Figure 19C:
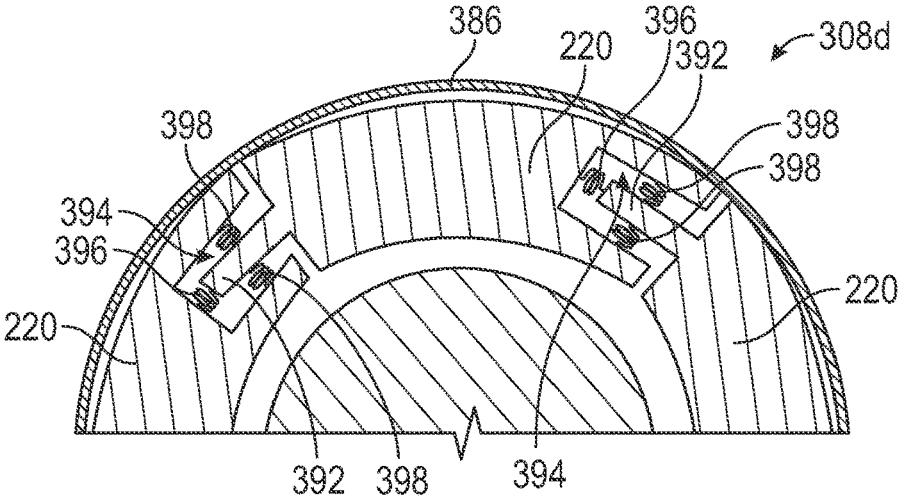

FIG. 19C is an axial view of the seal body and a retraction assembly according to another embodiment for the rotor seal assembly.

Figure 20:
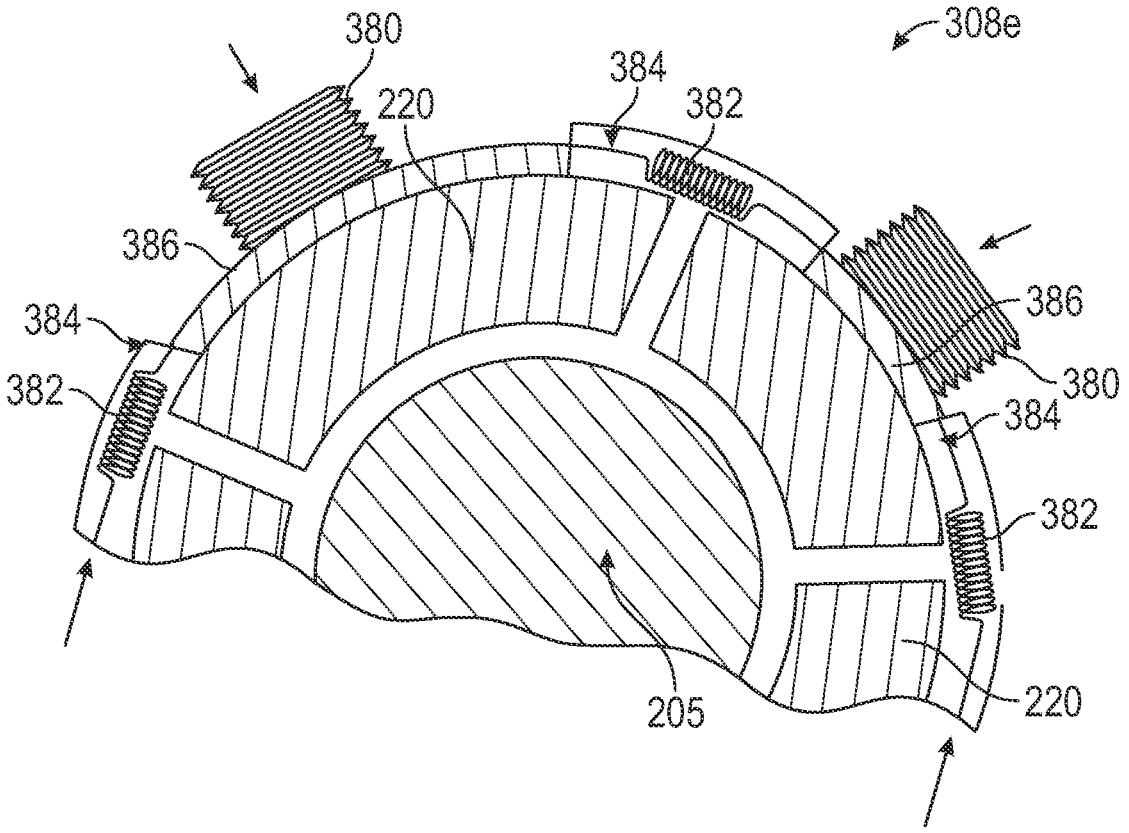

FIG. 20 is an axial view of the seal body and a retraction assembly according to another embodiment for the rotor seal assembly.

DETAILED DESCRIPTION

Features, advantages, and embodiments of the present disclosure are set forth or apparent from a consideration of the following detailed description, drawings, and claims. Moreover, the following detailed description is exemplary and intended to provide further explanation without limiting the scope of the disclosure as claimed.

Various embodiments are discussed in detail below. While specific embodiments are discussed, this is done for illustration purposes only. A person skilled in the relevant art will recognize that other components and configurations may be used without departing from the spirit and the scope of the present disclosure.

As may be used herein, the terms "first," "second," and "third" may be used interchangeably to distinguish one component from another and are not intended to signify location or importance of the individual components.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet, and aft refers to a position closer to an engine nozzle or an exhaust.

The terms "upstream" and "downstream" refer to the relative direction with respect to fluid flow in a fluid pathway. For example, "upstream" refers to the direction from which the fluid flows, and "downstream" refers to the direction to which the fluid flows.

The terms "coupled," "fixed," "attached," "connected," and the like, refer to both direct coupling, fixing, attaching, or connecting, as well as indirect coupling, fixing, attaching, or connecting through one or more intermediate components or features, unless otherwise specified herein.

The singular forms "a," "an," and "the" include plural references unless the context clearly dictates otherwise.

Additionally, as used herein, the terms "radial" or "radially" refer to a direction away from a common center. For example, in the overall context of a turbine engine, radial refers to a direction along a ray extending between a center longitudinal axis of the engine and an outer engine circumference As noted above, gas turbine engines used in aircraft are rotary engines and are an example of a rotary machines. The gas turbine engine, particularly, the turbomachine of the gas turbine engine, includes components that rotate. The rotating components of the turbomachine include, for example, compressor blades and turbine blades, each of which may extend radially outward from a rotating disk connected to a rotating shaft. Such rotating components, including the disk and the shaft, may be referred to herein as rotors. Other components of the turbomachine do not rotate, but, rather, are static or stationary relative to the rotation discussed above. Such components may be referred to herein as stators and include, for example, stationary nozzle blades located upstream of the rotating blades of a corresponding compressor stage or a turbine stage. Seals may be formed between the stator, such as the nozzle, and the rotor, such as the shaft, to prevent or otherwise to minimize leakage between the stator and the rotor.

One rotor seal assembly that may be used in such conditions includes a hydrodynamic seal. Such rotor seal assemblies may include a carriage assembly connected to the stator and have a seal cavity therein. A floating seal body may be attached to the carriage assembly such that the floating seal body moves in the radial direction of the turbomachine. The floating seal body may include a first seal face opposing a sealing surface of the rotor. Air may be forced into a gap formed between the first seal face and the sealing surface of the rotor, forming a film of air. As the rotor rotates during operation, the hydrodynamic forces of the film of air on the first seal face and the sealing surface of the rotor create a hydrodynamic seal while supporting the floating seal body such that the floating seal body does not contact the rotor. This non-contact seal prevents wear on the rotor and the seal body. When the turbomachine is not operating or is only operating at low speeds, the rotor is stationary or rotating slowly. Under such conditions, the air film in the gap between the first seal face and the sealing surface of the rotor may not produce sufficient hydrodynamic forces to maintain a proper clearance between the floating seal body and the rotor. The embodiments discussed herein include retraction assemblies for the floating seal body that retract the floating seal body from the rotor when the rotor is stationary or rotating slowly. The retraction assemblies also allow the floating seal body to move closer to the rotor when the rotor is rotating, and the hydrodynamic forces of the film of air in the gap between the first seal face and the sealing surface of the rotor are sufficient to maintain a proper clearance. In some of the embodiments discussed herein, operating conditions or operating characteristics of the gas turbine engine or rotor seal assembly may be used to drive movement of the retraction assembly.

Figure 1:
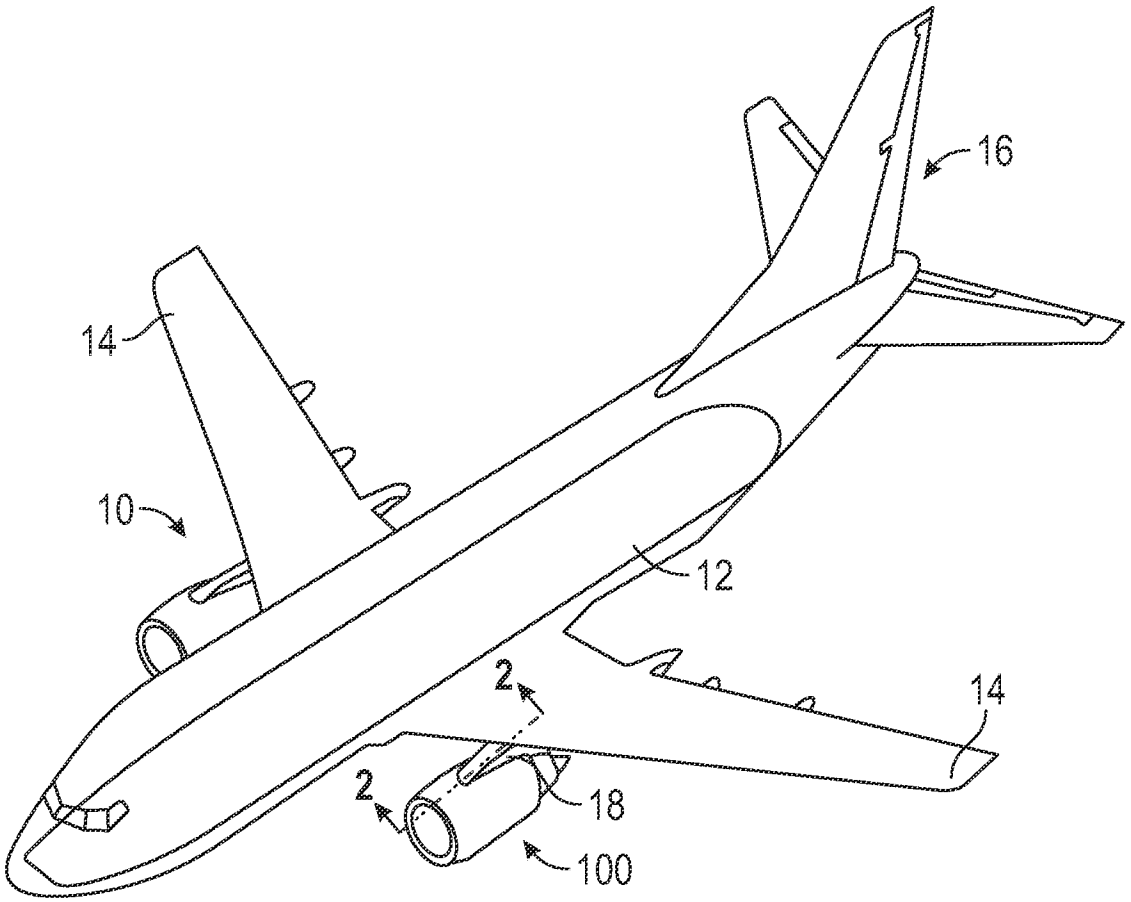
FIG. 1 is a schematic perspective view of an aircraft having gas turbine engines that may implement various embodiments of the present disclosure.

FIG. 1 is a perspective view of an aircraft 10 that may implement various preferred embodiments. The aircraft 10 includes a fuselage 12, wings 14 attached to the fuselage 12, and an empennage 16. The aircraft 10 also includes a propulsion system that produces a propulsive thrust required to propel the aircraft 10 in flight, during taxiing operations, and the like. The propulsion system for the aircraft 10 shown in FIG. 1 includes a pair of engines 100. In this embodiment, each engine 100 is attached to one of the wings 14 by a pylon 18 in an under-wing configuration. Although the engines 100 are shown attached to the wing 14 in an under-wing configuration in FIG. 1, in other embodiments, the engine 100 may have alternative configurations and be coupled to other portions of the aircraft 10. For example, the engine 100 may additionally or alternatively include one or more aspects coupled to other parts of the aircraft 10, such as, for example, the empennage 16, and the fuselage 12. Although the aircraft 10 shown in FIG. 1 is an airplane, the embodiments described herein may also be applicable to other aircraft 10, including, for example, helicopters and unmanned aerial vehicles (UAV). Further, although not depicted herein, in other embodiments, the gas turbine engine may be any other suitable type of gas turbine engine, such as an industrial gas turbine engine incorporated into a power generation system, a nautical gas turbine engine, etc.

Figure 2:
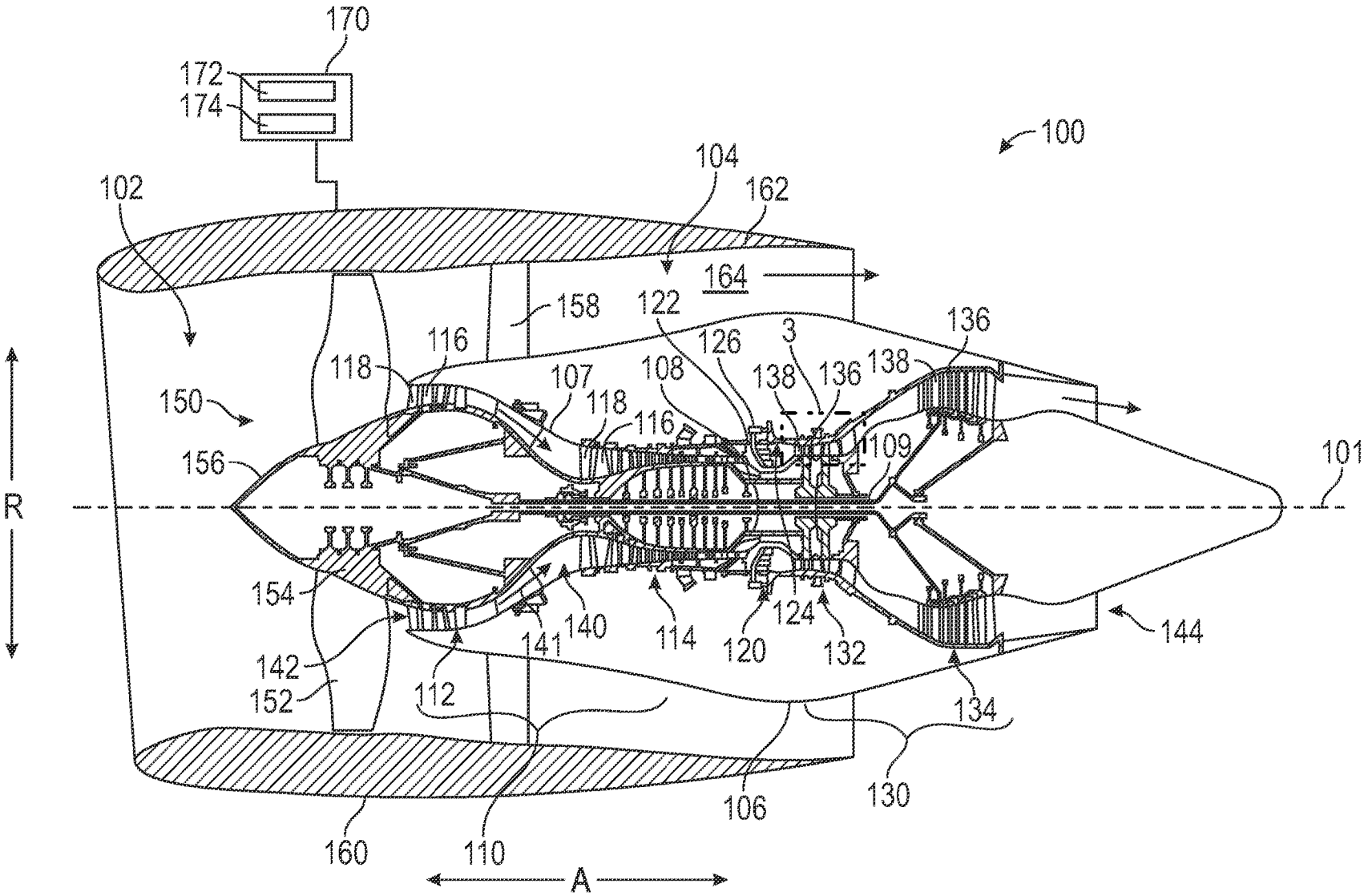
FIG. 2 is a schematic, cross-sectional view, taken along line 2-2 in FIG. 1, of one of the gas turbine engines of the aircraft shown in FIG. 1.

FIG. 2 is a schematic, cross-sectional view of one of the engines 100 used in the propulsion system for the aircraft 10 shown in FIG. 1. The cross-sectional view of FIG. 2 is taken along line 2-2 in FIG. 1. The engine 100 has an axial direction A (extending parallel to a longitudinal centerline 101, shown for reference in FIG. 2), a radial direction R, and a circumferential direction. The circumferential direction (not depicted in FIG. 2) extends in a direction rotating about the longitudinal centerline 101 (the axial direction A). In the embodiment depicted in FIG. 2, the engine 100 is a gas turbine engine and, more specifically, a high bypass turbofan engine, including a fan section 102 and a turbomachine 104 disposed downstream from the fan section 102.

The turbomachine 104 depicted in FIG. 2 includes a tubular outer casing 106 (also referred to as a housing or a nacelle) that defines an inlet 142. In this embodiment, the inlet 142 is annular. The outer casing 106 encases an engine core that includes, in a serial flow relationship, a compressor section 110 including a booster or a low-pressure (LP) compressor 112 and a high-pressure (HP) compressor 114, a combustion section 120, a turbine section 130 including a high-pressure (HP) turbine 132 and a low-pressure (LP) turbine 134, and a jet exhaust nozzle section 144. The compressor section 110, the combustion section 120, and the turbine section 130 together define at least in part a core air flow path 140 extending from the inlet 142 to the jet exhaust nozzle section 144, and through which air (a working air 141) flows.

Each of the LP compressor 112 and the HP compressor 114 may include a plurality of compressor stages. In each stage, a set of compressor blades 116 rotate relative to a corresponding set of static compressor vanes 118 (also called a nozzle) to compress or to pressurize the working air 141 passing through the stage. In a single compressor stage, a plurality of compressor blades 116 can be provided in a ring, extending radially outwardly relative to the longitudinal centerline 101 from a blade platform to a blade tip (e.g., extend in the radial direction R). The compressor blades 116 may be a part of a compressor rotor that includes a disk and the plurality of compressor blades 116 extend radially from the disk. Other configurations of the compressor rotor may be used, including, for example, blisks where the disk and the compressor blades 116 are integrally formed with each other to be a single piece. The corresponding static compressor vanes 118 are positioned upstream of and adjacent to the rotating compressor blades 116. The compressor vanes 118 for a stage of the compressor can be mounted to a core casing 107 in a circumferential arrangement. Each compressor stage may be used to sequentially compress the air (working air 141) flowing through the core air flow path 140. Any suitable number of compressor blades 116, compressor vanes 118, and compressor stages may be used.

Each of the HP turbine 132 and the LP turbine 134 also may include a plurality of turbine stages. In each stage, a set of turbine blades 136 rotate relative to a corresponding set of static turbine vanes 138 (also called a nozzle) to extract energy from the combustion products passing through the stage. The turbine blades 136 may be a part of a turbine rotor. Any suitable configuration for a turbine rotor may be used, including, for example, a disk with the plurality of turbine blades 136 extending from the disk. The corresponding static turbine vanes 138 are positioned upstream of and adjacent to the rotating turbine blades 136. The turbine vanes 138 for a stage of the turbine can be mounted to the core casing 107 in a circumferential arrangement.

In the combustion section 120, fuel, received from a fuel system (not shown) including a fuel source, is injected into a combustion chamber 124 of a combustor 122 by fuel nozzles 126. The fuel is mixed with compressed air from the compressor section 110 to form a fuel and air mixture, and combusted, generating combustion products (combustion gases). Adjusting a fuel metering unit (not shown) of the fuel system changes the volume of fuel provided to the combustion chamber 124 and, thus, changes the amount of propulsive thrust produced by the engine 100 to propel the aircraft 10. The combustion gases are discharged from the combustion chamber 124. These combustion gases may be directed into the turbine blades 136 of the HP turbine 132 and, then, the turbine blades 136 of the LP turbine 134, and the combustion gases drive (rotate) the turbine blades 136 of the HP turbine 132 and the LP turbine 134. Any suitable number of turbine blades 136, turbine vanes 138, and compressor stages may be used.

The engine 100 (turbomachine 104) further includes one or more drive shafts. More specifically, the engine 100 includes a high-pressure (HP) shaft 108 drivingly connecting the HP turbine 132 to the HP compressor 114, and a low-pressure (LP) shaft 109 drivingly connecting the LP turbine 134 to the LP compressor 112. The HP shaft 108 and the LP shaft 109 may also be referred to as spools. More specifically, the turbine rotors of the HP turbine 132 are connected to the HP shaft 108, and the compressor rotors of the HP compressor 114 are connected to the HP shaft 108. When the turbine blades 136 and, thus, the turbine rotors of the HP turbine 132 are rotated by the combustion gases flowing through the core air flow path 140, the turbine rotors of the HP turbine 132 rotate the compressor rotors and, thus, the compressor blades 116 of the HP compressor 114 via the HP shaft 108. Similarly, the turbine rotors of the LP turbine 134 are connected to the LP shaft 109, and the compressor rotors of the LP compressor 112 are connected to the LP shaft 109. When the turbine rotors and, thus, the turbine blades 136 of the LP turbine 134 are rotated by the combustion gases flowing through the core air flow path 140, the turbine rotors of the LP turbine 134 rotate the compressor rotors and, thus, the compressor blades 116 of the LP compressor 112 via the LP shaft 109. The HP shaft 108 and the LP shaft 109 are disposed coaxially about the longitudinal centerline 101. The HP shaft 108 has a larger diameter than the LP shaft 109, and the HP shaft 108 is located radially outward of the LP shaft 109. The HP shaft 108 and the LP shaft 109 are rotatable about the longitudinal centerline 101 and, as discussed above, coupled to rotatable elements such as the compressor rotors and the turbine rotors. Such components collectively may be referred to herein as a rotor 204 (see FIG. 3). Complementary to the rotor 204, the stationary portions of the engine 100, such as the static compressor vanes 118 and static turbine vanes 138, are also referred to individually or collectively as a stator 202 (see FIG. 3). As such, the stator 202 can refer to the combination of non-rotating elements throughout the engine 100.

The fan section 102 shown in FIG. 2 includes a fan 150 having a plurality of fan blades 152 coupled to a disk 154. The fan blades 152 and the disk 154 are rotatable, together, about the longitudinal centerline (axis) 101 by the LP shaft 109. The LP compressor 112 may also be directly driven by the LP shaft 109, as depicted in FIG. 2. The disk 154 is covered by a rotatable front hub 156 aerodynamically contoured to promote an airflow through the plurality of fan blades 152. Further, an annular fan casing or an outer nacelle 160 circumferentially surrounds the fan 150 and/or at least a portion of the turbomachine 104. The nacelle 160 is supported relative to the turbomachine 104 by a plurality of circumferentially spaced outlet guide vanes 158. A downstream section 162 of the nacelle 160 extends over an outer portion of the turbomachine 104 so as to define a bypass airflow passage 164 therebetween.

The engine 100 may also include an engine controller 170. The engine controller 170 is configured to operate various aspects of the engine 100, including, in some embodiments, the retraction assemblies 300 (see FIG. 3), discussed herein. The engine controller 170 may be a Full Authority Digital Engine Control (FADEC). In this embodiment, the engine controller 170 is a computing device having one or more processors 172 and one or more memories 174. The processor 172 can be any suitable processing device, including, but not limited to, a microprocessor, a microcontroller, an integrated circuit, a logic device, a programmable logic controller (PLC), an application-specific integrated circuit (ASIC), and/or a Field Programmable Gate Array (FPGA). The memory 174 can include one or more computer-readable media, including, but not limited to, non-transitory computer-readable media, a computer-readable non-volatile medium (e.g., a flash memory), a RAM, a ROM, hard drives, flash drives, and/or other memory devices.

The memory 174 can store information accessible by the processor 172, including computer-readable instructions that can be executed by the processor 172. The instructions can be any set of instructions or a sequence of instructions that, when executed by the processor 172, causes the processor 172 and the engine controller 170 to perform operations. In some embodiments, the instructions can be executed by the processor 172 to cause the processor 172 to complete any of the operations and functions for which the engine controller 170 is configured, as will be described further below. The instructions can be software written in any suitable programming language, or can be implemented in hardware. Additionally, and/or alternatively, the instructions can be executed in logically and/or virtually separate threads on the processor 172. The memory 174 can further store data that can be accessed by the processor 172.

The technology discussed herein makes reference to computer-based systems and actions taken by, and information sent to and from, computer-based systems. One of ordinary skill in the art will recognize that the inherent flexibility of computer-based systems allows for a great variety of possible configurations, combinations, and divisions of tasks and functionality between components and among components. For instance, processes discussed herein can be implemented using a single computing device or multiple computing devices working in combination. Databases, memory, instructions, and applications can be implemented on a single system or distributed across multiple systems. Distributed components can operate sequentially or in parallel.

The engine 100 shown in FIG. 2 and discussed herein (turbofan engine) is provided by way of example only. In other embodiments, any other suitable engine may be utilized with aspects of the present disclosure. For example, in other embodiments, the engine may be any other suitable gas turbine engine, such as a turboshaft engine, a turboprop engine, a turbojet engine, an unducted single fan engine, and the like. In such a manner, in other embodiments, the gas turbine engine may have other suitable configurations, such as other suitable numbers or arrangements of shafts, compressors, turbines, fans, etc. Further, although the engine 100 is shown as a direct drive, fixed-pitch turbofan engine, in other embodiments, a gas turbine engine may be a geared gas turbine engine (e.g., including a gearbox between the fan 150 and a shaft driving the fan, such as the LP shaft 109), may be a variable pitch gas turbine engine (i.e., including a fan 150 having a plurality of fan blades 152 rotatable about their respective pitch axes), etc. Further, still, in alternative embodiments, aspects of the present disclosure may be incorporated into, or otherwise utilized with, any other type of engine, such as reciprocating engines, or even have general applicability within other sealing systems for other rotary machines. For example, the embodiments may be applicable to a rotor seal assembly in other machines having rotary components that are variously used in industrial, commercial, and residential applications.

Figure 3:
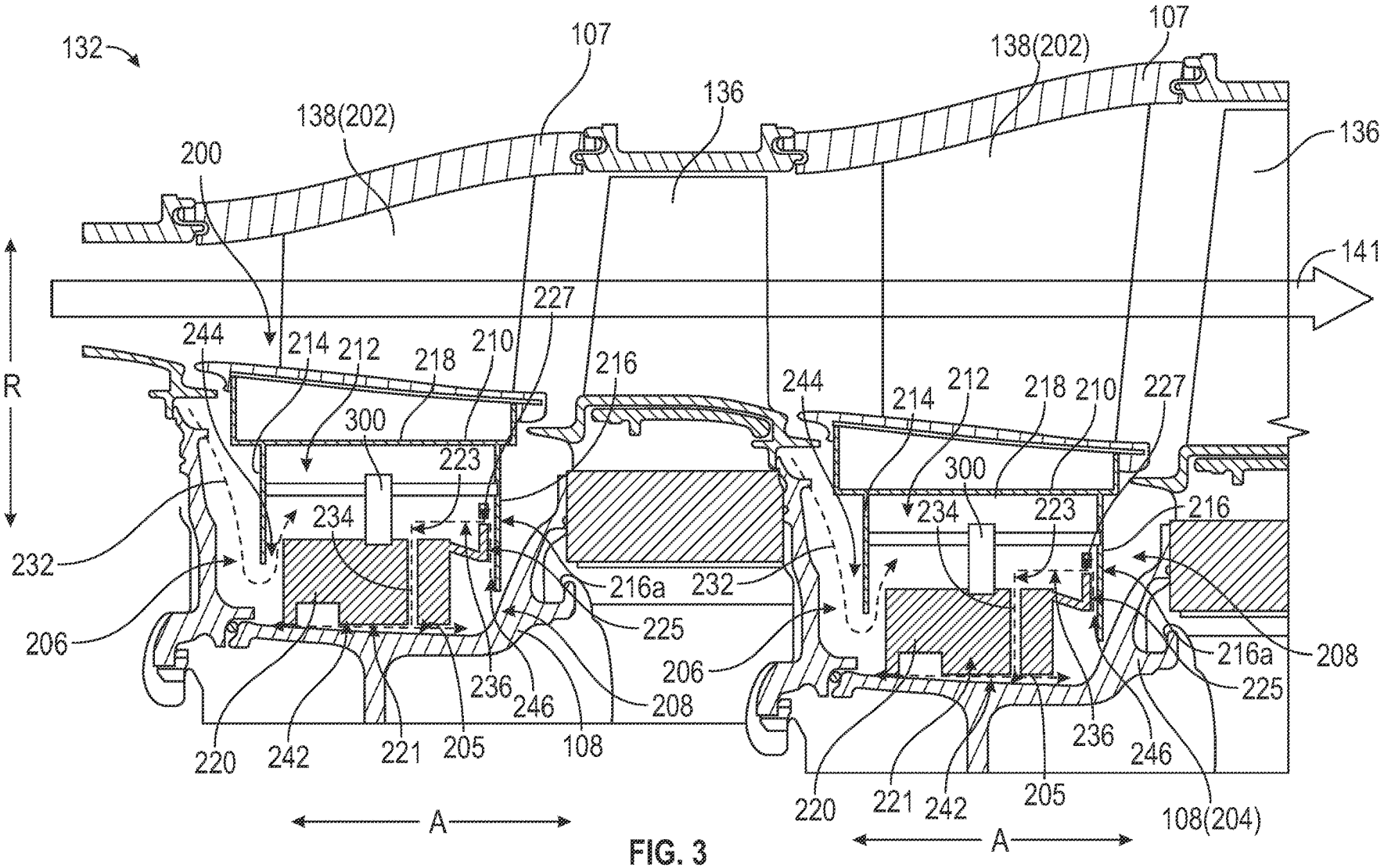
FIG. 3 is a schematic, detail cross-sectional view, showing detail 3 in FIG. 2, of two stages of a high-pressure (HP) turbine of the gas turbine engine shown in FIG. 2.

FIG. 3 is a schematic, detail cross-sectional view of two stages of the HP turbine 132, showing detail 3 in FIG. 2. FIG. 3 illustrates a rotor seal assembly 200 that may be used in the engine 100. In FIG. 3, two rotor seal assemblies 200 are shown and each rotor seal assembly 200 is attached to a stator 202. FIG. 3 illustrates a portion of the HP turbine 132, and, in the embodiment shown in FIG. 3, the stator 202 is a turbine vane 138 located between two turbine blades 136. Likewise, the rotor 204 of this embodiment is the HP shaft 108, and the rotor seal assembly 200 is located radially outward of the HIP shaft 108 between the stator 202 and the rotor 204. The rotor seal assembly 200 may circumferentially surround a perimeter of the rotor 204 that faces radially outward relative to the longitudinal centerline 101. The surface of the perimeter of the rotor 204 that faces radially outward relative to the longitudinal centerline 101 will be referred to as a rotor seal face 205, below. As noted above, however, the rotor seal assembly 200 can be positioned between any suitable rotating component (rotor 204) and stationary component (stator 202) of the engine 100 within any portion of the engine 100 such as, for example, in the fan section 102, the compressor section 110, or the turbine section 130. As such, the rotor seal assembly 200 can be attached to any suitable stationary component (stator 202) such as, but not limited to, the compressor vanes 118 or the turbine vanes 138.

The rotor seal assembly 200 includes a seal housing 210 attached to a radially inward portion of the stator 202 (turbine vane 138 in this embodiment). The seal housing 210 of this embodiment includes a plurality of walls defining a seal cavity 212. In this embodiment, the plurality of walls includes a forward wall 214, an aft wall 216, and an outer wall 218. The walls of the plurality of walls in this embodiment are referred to relative to their position within the engine 100 for ease of reference, but the forward wall 214, the aft wall 216, and the outer wall 218 may be a first wall, a second wall, and a third wall, respectively. In this embodiment, each of the forward wall 214 and the aft wall 216 extends, generally, in the radial direction R of the engine 100 and is generally transverse to the longitudinal centerline 101 (see FIG. 2). The outer wall 218 extends, generally, in the axial direction A of the engine 100 and is transverse to the forward wall 214 and the aft wall 216. The forward wall 214 and the aft wall 216 define at least a portion of the seal cavity 212 therebetween.

The rotor seal assembly 200 also includes a seal body 220. The seal body 220 of this embodiment is a floating seal body that is located within the seal cavity 212 of the seal housing 210. The seal body 220 is movable in the radial direction R within the seal cavity 212. The seal body 220 of this embodiment is thus positioned between the forward wall 214 and the aft wall 216. The seal body 220 includes a first seal face 221 opposing a rotor seal face 205 of the rotor 204. In this embodiment, the rotor seal face 205 is an outer circumferential surface of the HP shaft 108. As noted above, the rotor seal assembly 200 circumscribes the rotor 204 in this embodiment, and the rotor seal assembly 200 may be one or more seal segments that are annularly arranged around the rotor 204. For a rotor seal assembly 200 that includes a plurality of seal segments, the plurality of seal segments may respectively include one seal housing 210 and one or more seal bodies 220. With a plurality of seal segments, the plurality of seal bodies 220 may have an annular arrangement as shown in FIGS. 12 and 14 to 16, for example. In this annular arrangement, the plurality of seal bodies 220 is arranged circumferentially around the rotor 204 and circumscribes the rotor with one seal body 220 being adjacent to two other seal bodies 220.

As shown in FIG. 3, the rotor seal assembly 200 may separate an inlet plenum 206 from an outlet plenum 208. The inlet plenum 206 may define a region of the turbomachine 104 that includes a relatively higher-pressure fluid volume than the region of the outlet plenum 208. The outlet plenum 208, thus, may define a region of the turbomachine 104 that includes a relatively lower-pressure fluid volume. In this embodiment, the outlet plenum 208 is located downstream of the inlet plenum 206 in the direction of flow of the working air 141.

During operation of the turbomachine 104, a fluid may flow through one or more pathways of the rotor seal assembly 200. The fluid flow may provide for the non-contacting seal interface. In some embodiments, the fluid may include pressurized air, gas, and/or vapor, such as the combustion products in this embodiment. In other embodiments, the fluid may include a liquid. The first seal face 221 provides a non-contacting interface with the rotor seal face 205 of the rotor 204, and the non-contacting interface may include a dynamic fluid-bearing gap 242 between the first seal face 221 and the rotor seal face 205. Pressurized fluid within the dynamic fluid-bearing gap 242 may provide a fluid bearing, such as a gas bearing, that inhibits contact between the first seal face 221 and the rotor seal face 205. Radial movement of the seal body 220, such as responsive to transient operating conditions and/or aberrant movement of the rotor 204, may maintain a suitable dimension of the dynamic fluid-bearing gap 242, thereby providing proper functioning of the fluid bearing and/or inhibiting contact between the first seal face 221 and the rotor seal face 205.

In this embodiment, a portion of the working air 141 is a leakage fluid 232, and the leakage fluid 232 is used as the fluid that provides the non-contacting seal interface. A portion of the leakage fluid 232 may flow from the inlet plenum 206 into the seal cavity 212 by one or more inlet apertures 244. The inlet apertures 244 may be formed between a forward end of the seal body 220 and the forward wall 214. The inlet apertures 244 may include one or more channels, conduits, passages, or the like, that pass through the seal housing 210 and/or the seal body 220. The rotor seal assembly 200 may also include one or more primary fluid conduits 223 that fluidly connect the seal cavity 212 to the dynamic fluid-bearing gap 242 and supply the fluid (primary leakage air 234) to the dynamic fluid-bearing gap 242. The primary leakage air 234 flows within the dynamic fluid-bearing gap 242 towards either the inlet plenum 206 or the outlet plenum 208, as the rotor 204 rotates and, thus, provides the hydrodynamic film of air that both forms a seal and maintains the dynamic fluid-bearing gap 242 between the seal body 220 and the rotor 204.

The rotor seal assembly 200 of this embodiment also includes a hydrostatic bearing seal. The seal body 220 of this embodiment includes a second seal face 225 opposing a an inward-facing surface 216*a* of the aft wall 216. The second seal face 225 provides a non-contacting interface with the seal housing 210 and, more specifically, the inward-facing surface 216*a* of the aft wall 216. This non-contacting interface may include a static fluid-bearing gap 246 between the second seal face 225 and the inward-facing surface 216*a* of the aft wall 216. Pressurized fluid within the static fluid-bearing gap 246 may provide a fluid film that inhibits contact between the second seal face 225 and the inward-facing surface 216*a*. As neither the aft wall 216 nor the seal body 220 are actively rotating, the static fluid-bearing gap 246 is static. The static fluid-bearing gap 246 allows for some radial movement of the seal body 220 relative to the seal housing 210 and maintains a seal between the outlet plenum 208 and the seal cavity 212. The rotor seal assembly 200 may also include one or more secondary fluid conduits 227 that fluidly connect the seal cavity 212 to the static fluid-bearing gap 246 and supply the fluid (secondary leakage air 236) to the static fluid-bearing gap 246. The secondary leakage air 236 flows within the static fluid-bearing gap 246 towards either the seal cavity 212 or the outlet plenum 208, providing a film of air that both forms a seal and maintains the static fluid-bearing gap 246 between the seal body 220 and the seal housing 210.

As discussed above, the rotor seal assembly 200 is a hydrodynamic bearing where the primary leakage air 234 provides a film of air within the dynamic fluid-bearing gap 242, and maintains the non-contact interface between the seal body 220 and the rotor 204. The primary leakage air 234 of this embodiment is leakage fluid 232 from the working air 141 flowing through the core air flow path 140. When the turbomachine 104 is not operating, or only operating at low speeds, the leakage fluid 232 and, thus, the primary leakage air 234 are not present to maintain the dynamic fluid-bearing gap 242 between the first seal face 221 and the rotor seal face 205. Moreover, the flow of the leakage fluid 232 through inlet apertures 244, the seal cavity 212, the primary fluid conduits 223, and the dynamic fluid-bearing gap 242 may be driven by the differential pressure across the rotor seal assembly 200, that is, the differential pressure between the relatively high pressure in the inlet plenum 206 and the relatively low pressure in the outlet plenum 208. Thus, at low differential pressures, the flow of primary leakage air 234 may not be sufficient to maintain the dynamic fluid-bearing gap 242. The rotor seal assembly 200 of this embodiment thus includes a retraction assembly 300 for the seal body 220.

The seal body 220 is movable in a retraction direction and in an extension direction. The retraction direction is a direction away from the rotor seal face 205 and the extension direction is a direction towards the rotor seal face 205. The retraction assembly 300 of the embodiments discussed herein is connected to the seal body 220 to move the seal body 220 in at least the retraction direction. In many of the embodiments discussed herein, the seal body 220 moves radially outward for the retraction direction and radially inward for the extension direction. As will be discussed further below, the retraction assembly 300 may utilize various operating conditions or operating characteristics of the engine 100 or the rotor seal assembly 200 to drive movement of the retraction assembly 300. The seal body 220 may have a plurality of positions to which the retraction assembly 300 can move and position the seal body 220.

In each of the embodiments discussed below, the retraction assembly 300 includes one or more springs arranged to impart a biasing force to the seal body 220 to move the seal body 220 in the retraction direction. When the turbomachine 104 is operated, the rotor seal assembly 200 is exposed to certain operating conditions or operating characteristics to move the seal body 220 in the extended direction. In many of the embodiments discussed below, such operating conditions may include, for example, the leakage fluid 232 developing a pressure withing the seal cavity 212 and imparting a radially inward force on a seal cavity surface 229 of the seal body 220 to move the seal body 220 in the extension direction against the biasing force of the at least one spring in the retraction assembly 300. As the seal body 220 and, more specifically, the first seal face 221 approaches the rotor seal face 205 with the primary leakage air 234 flowing through the primary fluid conduits 223, a thin film of air develops within the dynamic fluid-bearing gap 242 and imparts hydrodynamic forces on the rotor seal face 205 and the first seal face 221 to maintain the dynamic fluid-bearing gap 242.

Figure 4A:
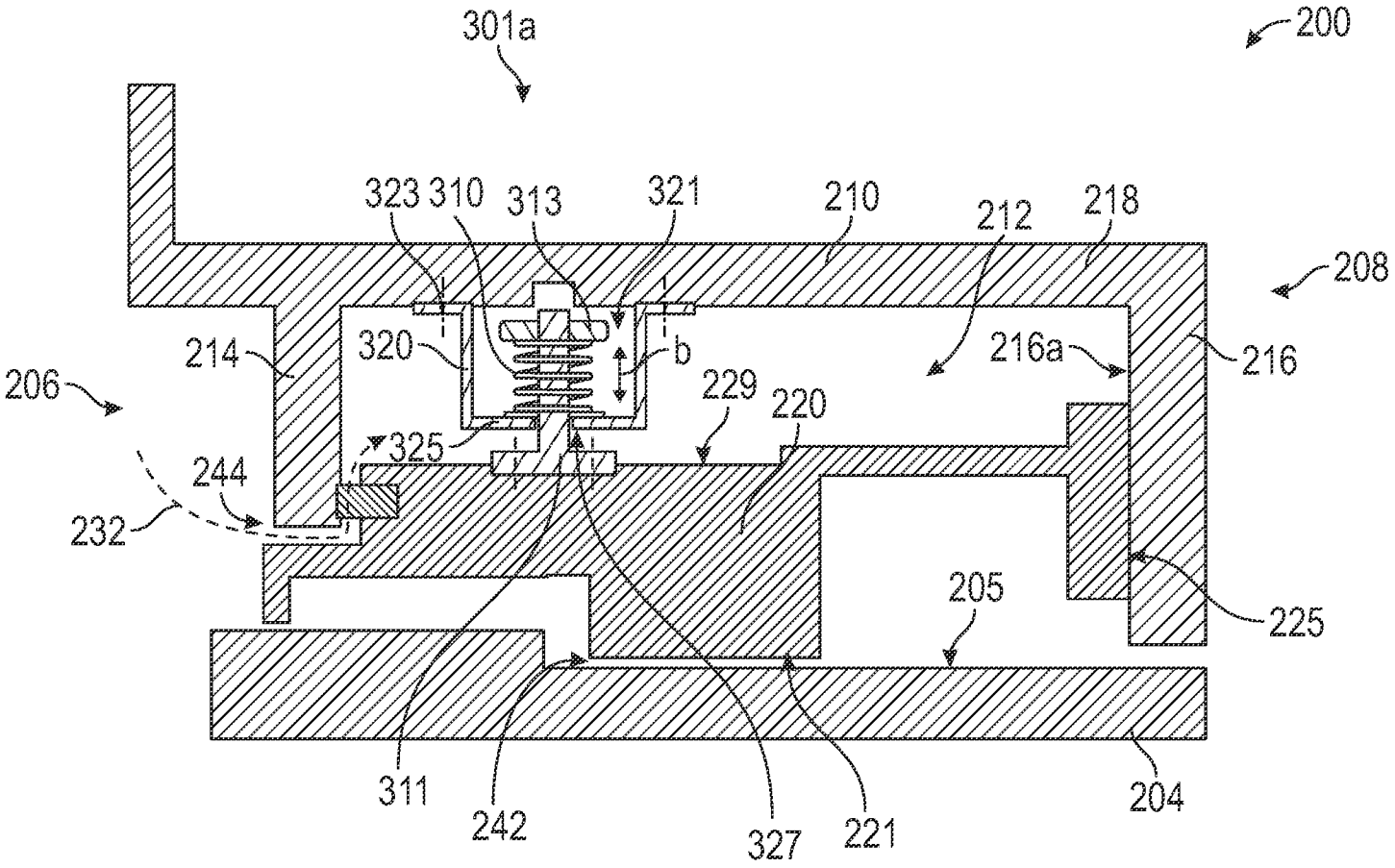
FIG. 4A is a schematic cross-sectional view of a rotor seal assembly including a retraction assembly according to a first embodiment.

FIG. 4A is a schematic cross-sectional view of the rotor seal assembly 200 including a retraction assembly 301*a* according to a first embodiment. As used herein, reference numeral 300 refers generically to the retraction assemblies discussed herein and, where a specific retraction assembly is discussed, reference numerals 301*a*, 301*b*, 301*c*, 302, 303, etc., will be used to refer to the specific retraction assembly. For clarity with the other retraction assemblies discussed herein, the retraction assembly 301*a* of this embodiment will be referred to as a radial-helical-spring retraction assembly 301*a*. The discussion of the rotor seal assembly 200 above applies to each of the retraction assemblies 300 discussed herein unless noted otherwise.

The radial-helical-spring retraction assembly 301*a* of this embodiment uses a spring 310. The spring 310 of this embodiment is a helical spring connected to the seal body 220 to bias the seal body 220 in the retraction direction.

More specifically, in this embodiment, the spring 310 is a compression spring, but any suitable spring arrangement may be used including, for example, tension springs and torsion springs. A shaft 311 is attached or otherwise connected to the seal body 220 and the spring 310. In this embodiment, the shaft 311 extends radially outward from the seal body 220 and into a cavity 321 attached to, or otherwise formed in, the seal housing 210. More specifically, in this embodiment, the cavity 321 is formed withing a spring housing 320 having an outer flange 323 attached to the seal housing 210 and, more specifically, the outer wall 218 of the seal housing 210. The spring housing 320 also includes an inner wall 325 having a hole 327 formed therein. The shaft 311 is inserted into the cavity 321 through the hole 327 in the inner wall 325. A flange 313 is attached to the shaft 311. The spring 310 is wrapped around the shaft 311 and positioned between the inner wall 325 and the flange 313 to push the inner wall 325 and the flange 313 away from each other in a biasing direction b, causing the shaft 311 and, thus, the seal body 220 to move in the retraction direction. The spring 310 thus includes an axial direction (or longitudinal direction), and the axial direction is aligned in the radial direction R.

When the turbomachine 104 is not operating, the spring 310 moves the seal body 220 to a fully retracted position by the biasing force of the spring 310. As the turbomachine 104 begins to operate, the pressure differential between the inlet plenum 206 and the outlet plenum 208 builds up and the leakage fluid 232 flows into the seal cavity 212 though the inlet apertures 244 as discussed above. Pressure thus builds within the seal cavity 212 and pushes downward on a seal cavity surface 229, which is an outer surface of the seal body 220 in this embodiment, to move the seal body 220 in the extension direction against the biasing force of the spring 310. Then, the combination of the pressure within the seal cavity 212 and on the seal cavity surface 229 balances and maintains the seal body 220 in the desired position in conjunction with the air film within the dynamic fluid-bearing gap 242.

The spring 310 may also be a thermally activated spring, such as a spring that is formed from a shape memory alloy (SMA) or bimetallic materials. The spring 310 may be formed from one of a plurality of materials generally recognized to fall within the class of "shape memory alloys." In the applications discussed herein, the shape memory alloy is preferably a high-temperature shape memory alloy. One suitable high-temperature shape memory alloy is, for example, a nickel-titanium alloy known under the trade name Nitinol©. Other suitable shape memory alloys include, for example, cobalt-nickel-aluminum alloys, nickel-iron-gallium alloys, iron-manganese-gallium alloys, and cobalt-nickel-gallium alloys. When the spring 310 is made from a bimetallic material, a first metal and a second metal are used, and the first and second metals for the applications discussed herein include, for example, steels, such as stainless steels, titanium, titanium alloys, nickel and nickel alloys such as Inconel©, RENE™, and Hastalloy™.

Shape memory alloys may undergo a phase change with changes (an increase or a decrease) in temperature. Nitinol®, for example, may change between an austenitic phase and a martensitic phase. The temperature (or temperature range) at which this phase change occurs may be referred to as a transformation temperature. The shape memory alloy used to form the spring 310 is selected to have a transformation temperature range appropriate for any thermal cycling to which the rotor seal assembly 200 and, more specifically, the radial-helical-spring retraction assembly 301*a* is exposed. As the radial-helical-spring retraction assembly 301*a* and, more specifically, the spring 310 increases in temperature, such as during start up, or decreases in temperature, such as during cool down, for example, the spring 310 will pass through the transition temperature and the shape memory alloy undergoes a phase change. With this phase change, the spring 310 will change shape. For example, the spring 310 has an axial length and the axial length may expand or contract as the spring 310 passes through the transition temperature. As noted above, the spring 310 abuts the flange 313 and the inner wall 325, and with the phase change, the spring 310 moves the flange 313 and the inner wall 325 relative to each other. For example, the spring 310 is at a low temperature when the turbomachine 104 is not operating and the spring 310 has an axial length that positions the seal body 220 and, more specifically, the first seal face 221 away from the rotor seal face 205. When the temperature increases, such as during startup, and the shape memory alloy spring 310 undergoes a phase change, the spring 310 may contract, moving the flange 313 and the inner wall 325 closer to each other and, thus, moving the seal body 220 in the extension direction. Conversely, as the temperature decreases, such as during cool down, the spring 310 undergoes a phase change increasing the axial length of the spring 310. The increase in the axial length moves the flange 313 and the inner wall 325 further from each other and, thus, moves the seal body 220 in the retraction direction. In this way, the seal body 220 is in a retracted position when the spring 310 is at a first temperature, and the seal body 220 is in an extended position when the spring 310 is at a second temperature greater than the first temperature. The first seal face 221 of the seal body 220 is closer to the rotor seal face 205 in the extended position than in the retracted position.

Figure 4B:
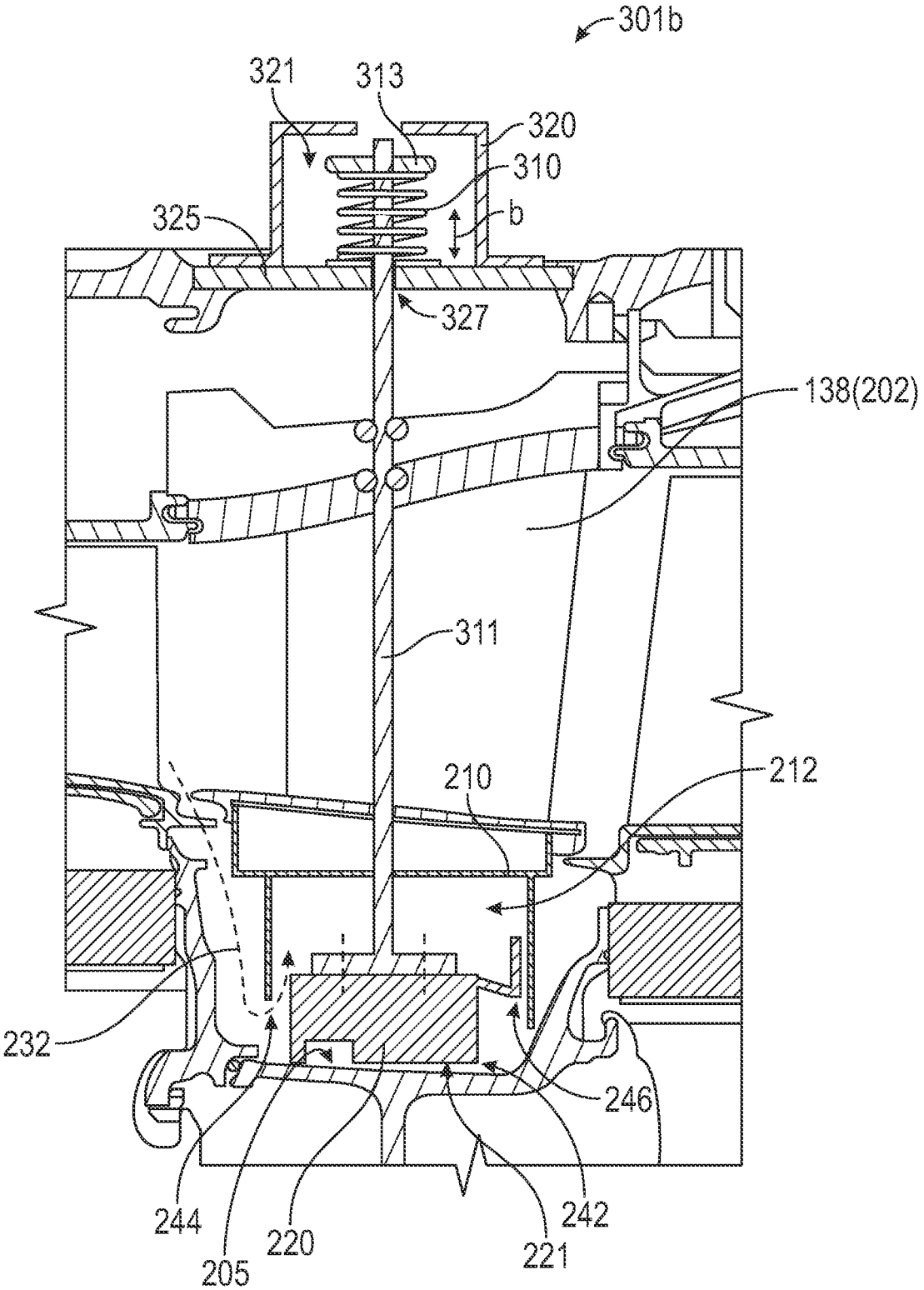
FIG. 4B is a schematic cross-sectional view of the rotor seal assembly with the retraction assembly of FIG. 4A in a different position relative to a stator.

FIG. 4B is a schematic cross-sectional view of the rotor seal assembly 200 including a retraction assembly 301*b* according to another embodiment. The retraction assembly 301*b* of this embodiment is similar to the radial-helical-spring retraction assembly 301*a* discussed above with reference to FIG. 4A, and, given the degree of similarity with the radial-helical-spring retraction assembly 301*a*, the retraction assembly 301*b* of this embodiment also will be referred to as a radial-helical-spring retraction assembly 301*b*. The same reference numerals will be used for components of the radial-helical-spring retraction assembly 301*b* of this embodiment that are the same or similar to the components of the radial-helical-spring retraction assembly 301*a* discussed above. The description of these components above also applies to this embodiment, and a detailed description of these components is omitted here. In the embodiment shown in FIG. 4A, the spring 310 and the spring housing 320 are connected to the seal housing 210 and positioned within the seal cavity 212, but the spring 310 and the spring housing 320 may be positioned at any suitable location. As shown in FIG. 4B, for example, the spring housing 320 is attached to the core casing 107 and positioned outside of the core casing 107 (a stator case).

Figure 4C:
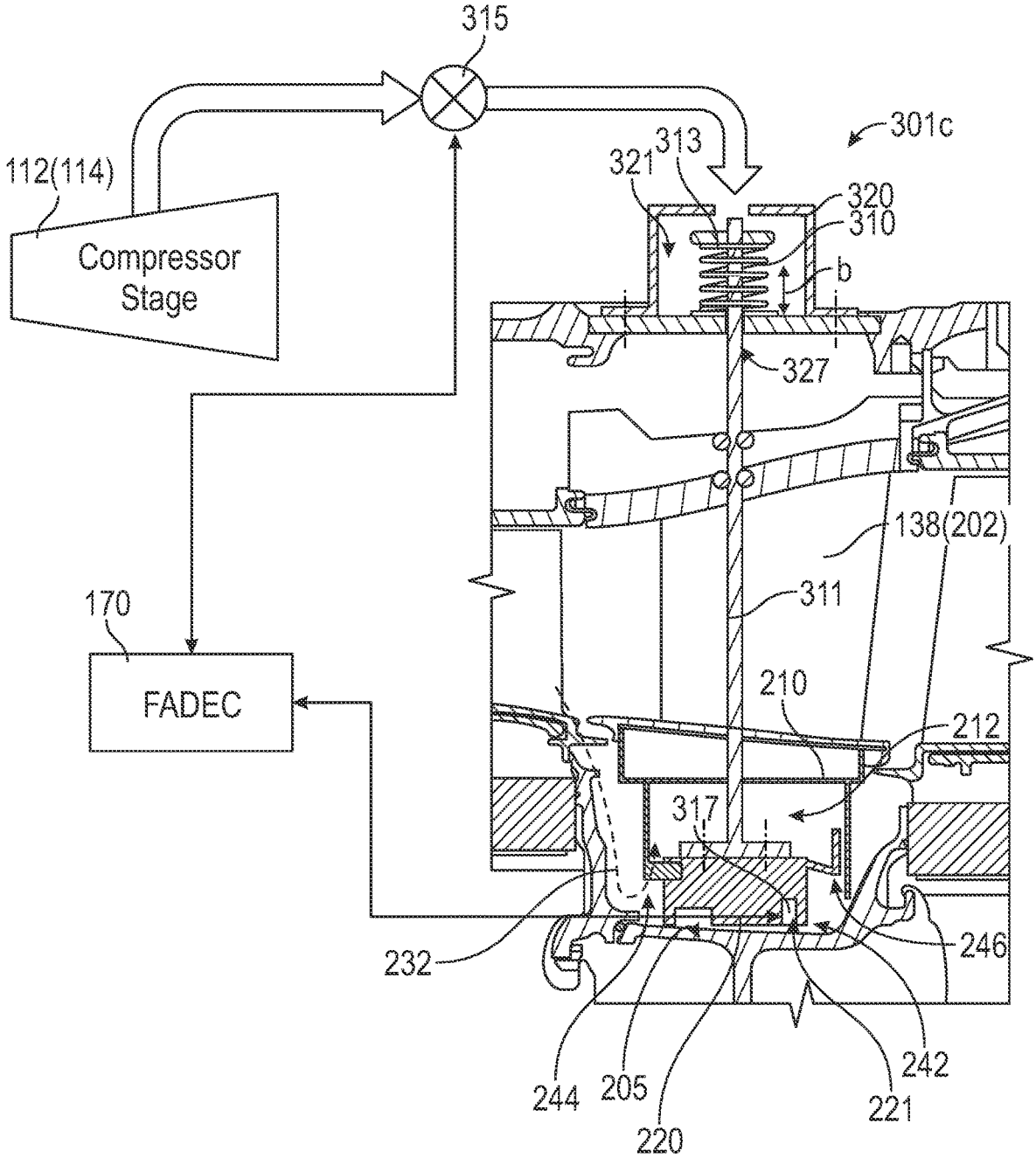
FIG. 4C is a schematic cross-sectional view of the rotor seal assembly 200 including a variation of the retraction assembly shown in FIG. 4B.

FIG. 4C is a schematic cross-sectional view of the rotor seal assembly 200 including a retraction assembly 301*c* according to another embodiment. The retraction assembly 301*c* of this embodiment is similar to the radial-helical-spring retraction assemblies 301*a*, 301*b* discussed above with reference to FIGS. 4A and 4B, and, given the degree of similarity with the radial-helical-spring retraction assemblies 301*a*, 301*b*, the retraction assembly 301*b* of this embodiment also will be referred to as a radial-helical-spring retraction assembly 301*c*. The same reference numerals will be used for components of the radial-helical-spring retraction assembly 301*c* of this embodiment that are the same or similar to the components of the radial-helical-spring retraction assemblies 301*a*, 301*b* discussed above. The description of these components above also applies to this embodiment, and a detailed description of these components is omitted here.

As noted in the embodiments above, the spring 310 may be a thermally activated spring made from a shape memory alloy (SMA) or bimetallic materials. Instead of, or in addition to, relying on ambient conditions to drive the temperature of the cavity 321 and, thus, the spring 310, the temperature of the cavity 321 may be actively controlled. The temperature of the cavity 321 may be actively controlled by a suitable controller, such as the engine controller 170. The engine controller 170 is communicatively and operatively coupled to a suitable temperature control device to control the temperature within the cavity 321. The temperature control device may be any suitable device, such as an induction heater controlling the temperature of the spring 310. In the embodiment shown in FIG. 4C, the engine controller 170 is operatively coupled to a valve 315 to control an airflow into the cavity 321 from an air source. The cavity 321 is fluidly coupled to the air source. Opening or closing the valve 315 adjusts the flow of air into the cavity 321 and can thus be used to control the temperature of the cavity 321, such as by air impingement on the spring 310. Adjusting the position (amount open or closed) of the valve 315 also adjusts the pressure within the cavity 321, which may also adjust the position of the seal body 220 relative to the rotor seal face 205. Any suitable air source may be used, but, in this embodiment, the air source is compressor blead air from one of the LP compressor 112 or the HP compressor 114.

The engine controller 170 may use various suitable inputs to control the temperature, via the valve 315 in this embodiment, of the cavity 321 and, thus the temperature of the spring 310. The rotor seal assembly 200 of this embodiment includes a gap sensor 317 configured to determine the distance between the rotor seal face 205 and the first seal face 221 and, thus, the size of the dynamic fluid-bearing gap 242. Any suitable gap sensor 317 may be used including, for example, a laser sensor, an ultrasonic sensor, or other non-contact sensor. The engine controller 170 is communicatively coupled to the gap sensor 317 to receive gap information from the gap sensor 317. The engine controller 170 is configured to adjust the temperature of the cavity 321 based on the gap information received from the gap sensor 317 by operating a temperature control device, such as the valve 315. The gap sensor 317 is shown as being located within the seal body 220, but the gap sensor 317 may be located at any suitable location to measure the distance between the rotor seal face 205 and the first seal face 221.

Figure 6:
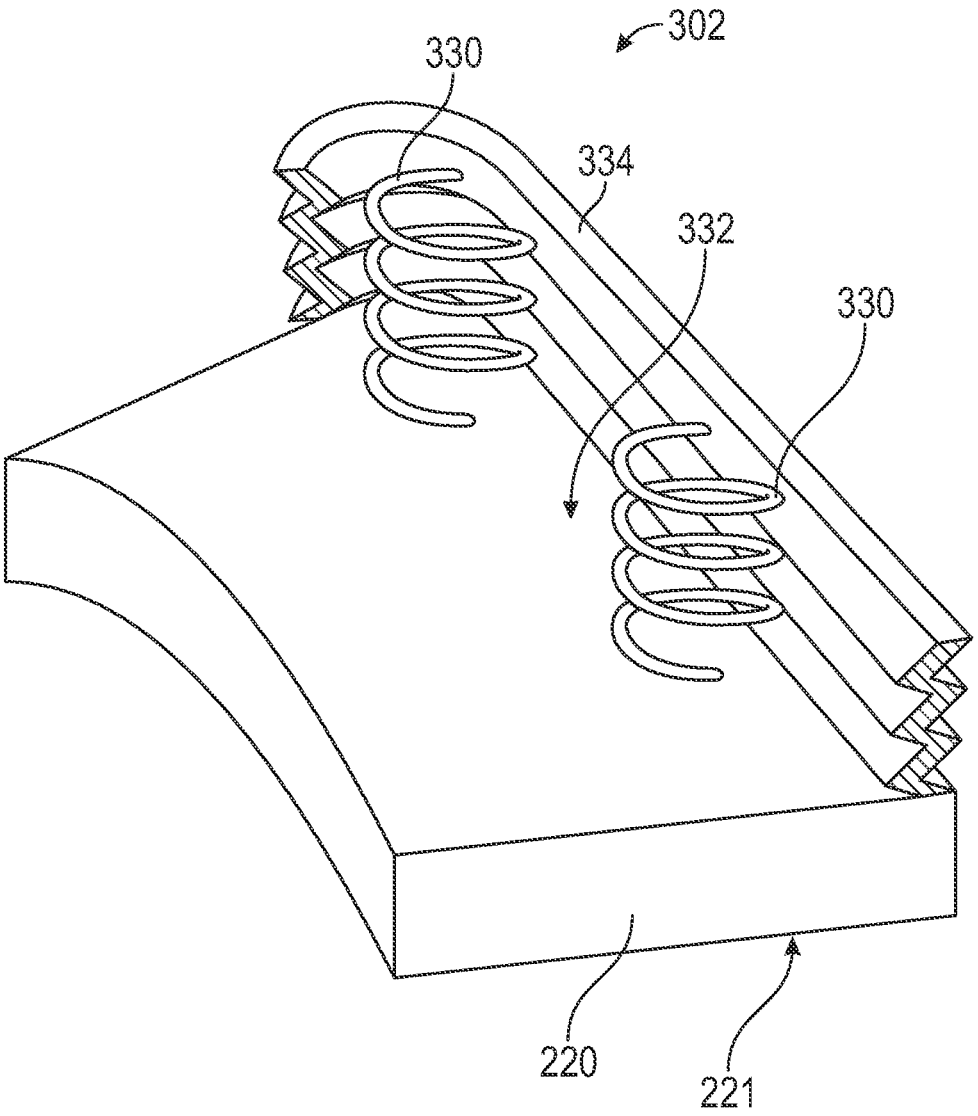

FIGS. 5 and 6 show the rotor seal assembly 200 including a retraction assembly 302 according to another embodiment. For clarity with the other retraction assemblies discussed herein, the retraction assembly 302 of this embodiment will be referred to as a spring and bellows retraction assembly 302. FIG. 5 is a schematic cross-sectional view of the rotor seal assembly 200 including the spring and bellows retraction assembly 302 according to this embodiment, and FIG. 6 shows the seal body 220 and the spring and bellows retraction assembly 302. The spring and bellows retraction assembly 302 of this embodiment includes a spring 330 that imparts a biasing force in a biasing direction b to move the seal body 220 in the retraction direction. The spring 330 of this embodiment is depicted in FIGS. 5 and 6 as a helical, extension spring, but any suitable spring may be used, including the spring 310 discussed in the embodiments above with respect to FIGS. 4A, 4B, and 4C.

In the embodiments discussed above, the seal body 220 was moved in the extension direction by either the pressure within the seal cavity 212 or a temperature change imparted to the spring 310. In this embodiment, a fluid pressure, such as air pressure, may also be used to move the seal body 220 in the extension direction, but, in this embodiment, the pneumatic load is applied within a cavity 332 of a bellows 334. The spring and bellows retraction assembly 302 of this embodiment includes the spring 330 and the bellows 334. The bellows 334 of this embodiment is connected to the seal body 220 (more specifically, the seal cavity surface 229) and the seal housing 210 (more specifically, the outer wall 218 of the seal housing 210). A pneumatic load (pressure) is applied to the cavity 332 of the bellows 334 from a pressure source 336 to move the seal body 220 in the extension direction. As with the embodiments discussed above with reference to FIGS. 4A and 4B, the pressure source 336 may be the leakage fluid 232, but any suitable source may be used including, for example, the compressor blead air, as is used in the embodiment discussed above with respect to FIG. 4C. In the latter case, the pressure of the air within the cavity 332 of the bellows 334 may be controlled by the engine controller 170 operatively coupled to a valve 315 in the manner discussed above with reference to FIG. 4C.

As shown in FIG. 6 a plurality of springs 330 may be connected to the seal body 220 to move the seal body 220 in the retraction direction. In this embodiment, two springs 330 are shown and the plurality of springs 330 are located within the bellows 334. Of course, any suitable number of springs may be used as desired.

FIGS. 7 and 8 show the rotor seal assembly 200 including a retraction assembly 303 according to another embodiment. For clarity with the other retraction assemblies discussed herein, the retraction assembly 303 of this embodiment will be referred to as a leaf-spring retraction assembly 303. FIG. 7 is a schematic cross-sectional view of the rotor seal assembly 200 including the leaf-spring retraction assembly 303 according to this embodiment, and FIG. 8 is a cross-sectional view of the leaf-spring retraction assembly 303 taken along line 8-8 in FIG. 7. The leaf-spring retraction assembly 303 of this embodiment includes a leaf spring 340 that imparts a biasing force in a biasing direction b to move the seal body 220 in the retraction direction. In FIG. 7, the leaf spring 340 is depicted with a single strip, but any suitable number of strips may be used, including a plurality of strips. The leaf spring 340 includes a longitudinal direction and the biasing direction b is a direction transverse to the longitudinal direction of the leaf spring 340. In this embodiment, the leaf spring 340 extends in the axial direction A of the engine 100 and the biasing direction b is radially outward. The leaf spring 340 of this embodiment is rectilinear, but other suitable shapes may be used including, for example, an arcuate shape or other curvilinear shapes. The leaf spring 340 is attached to the seal housing 210 and, more specifically, the forward wall 214 and the aft wall 216. The seal body 220 is connected to the leaf spring 340 by a linkage 342 such that the seal body 220 is suspended from the leaf spring 340. One end of the linkage 342 (an inner end) may attached to the seal body 220 and the other end of the linkage 342 (an outer end) may be connected to the leaf spring 340. In this embodiment, the outer end of the linkage 342 is attached to a sleeve 344, and the sleeve 344 surrounds the leaf spring 340. The sleeve 344 has a degree of freedom to move axially along the length (longitudinal direction) of the leaf spring 340. The outer end of the linkage 342 may be pivotably connected to the sleeve 344 using any suitable pivotable connection, such as a threaded pin 346, to allow for some relative pivotable movement of the seal body 220.

The leaf-spring retraction assembly 303 and, more specifically, the leaf spring 340 maintains the seal body 220 in a retracted position when the turbomachine 104 is not operating. As in the embodiment discussed above with respect to FIG. 4A, the pressure within the seal cavity 212 presses on the seal cavity surface 229 of the seal body 220 against the biasing force of the spring to move the seal body 220 in the extension direction. When the pressure in the seal cavity 212 is reduced, such as by shutting down, the biasing force of the leaf spring 340 moves the seal body 220 in the retraction direction. The stiffness of the leaf spring 340 can be tuned to provide the desired deflection during operation.

FIG. 9 is a schematic cross-sectional view of the rotor seal assembly 200 including a retraction assembly 304 according to another embodiment. For clarity with the other retraction assemblies discussed herein, the retraction assembly 304 of this embodiment will be referred to as a leaf/helical-spring retraction assembly 304. The leaf/helical-spring retraction assembly 304 of this embodiment is similar to the leaf-spring retraction assembly 303 discussed above with reference to FIGS. 7 and 8. The same reference numerals will be used for components of the leaf/helical-spring retraction assembly 304 of this embodiment that are the same or similar to the components of the leaf-spring retraction assembly 303 discussed above with reference to FIGS. 7 and 8. The description of these components above also applies to this embodiment, and a detailed description of these components is omitted here.

In this embodiment, the leaf spring 340 (a first spring) is connected in series with a helical spring 348 (a second spring). The leaf spring 340 imparts a first biasing force $b_1$ to the seal body 220, and the helical spring 348 imparts a second biasing force $b_2$ to the seal body 220. In this embodiment, the leaf spring 340 has an arcuate shape and is connected directly to the seal body 220, such as by a fastener, for example, but the leaf spring 340 of this embodiment may have other suitable shapes including those discussed above. The helical spring 348 is oriented in the axial direction A of the turbomachine 104, and, thus, imparts the second biasing force $b_2$ on the leaf spring 340 that is in a direction transverse and, more specifically, in this embodiment, orthogonal to the first biasing force $b_1$ imparted by the leaf spring 340 on the seal body 220. The combination of the leaf spring 340 and the helical spring 348 thus moves the seal body 220 in the retraction direction. As in the embodiments discussed above, air applying a pneumatic pressure from a pressure source 336 may be applied to the seal cavity 212 to move the seal body 220 in the extension direction. The pressure sources 336 discussed above, including the leakage fluid 232 or compressor bleed air, may be used in this embodiment in a similar manner to those discussed above.

FIG. 10 is a schematic cross-sectional view of the rotor seal assembly 200 including a retraction assembly 305 according to another embodiment. For clarity with the other retraction assemblies discussed herein, the retraction assembly 305 of this embodiment will be referred to as a spring-bar retraction assembly 305. The spring-bar retraction assembly 305 of this embodiment is similar to the leaf-spring retraction assembly 303 discussed above with reference to FIGS. 7 and 8. The same reference numerals will be used for components of the spring-bar retraction assembly 305 of this embodiment that are the same or similar to the components of the leaf-spring retraction assembly 303 discussed above with reference to FIGS. 7 and 8. The description of these components above also applies to this embodiment, and a detailed description of these components is omitted here.

In this embodiment, a bar, referred to herein as a spring bar 352, is used in place of the leaf spring 340. The spring bar 352 is a bar having an elasticity to impart a biasing force to the seal body 220 in the retraction direction and that may be elastically deformed by pneumatic pressurization of the seal cavity 212 in the manner discussed in the embodiments above. The seal body 220 is connected to and suspended from the spring bar 352 by a segment plate 354 containing a hole 356. The spring bar 352 extends through the hole 356 of the segment plate 354 and the clearance of the hole 356 is large enough to allow the segment plate 354 and, thus, the seal body 220 to move both radially (in the extension direction and the retraction direction) and axially in the longitudinal direction of the spring bar 352. That is, a dimension of the hole 356 in the radial direction, such as diameter when the hole 356 is circular, is greater than a corresponding dimension of the spring bar 352 in the radial direction, such as diameter when the spring bar 352 is cylindrical.

FIGS. 11 and 12 show the rotor seal assembly 200 including a retraction assembly 306 according to another embodiment. For clarity with the other retraction assemblies discussed herein, the retraction assembly 306 of this embodiment will be referred to as a tangential-spring retraction assembly 306. FIG. 11 is a schematic cross-sectional view of the rotor seal assembly 200 including the tangential-spring retraction assembly 306 according to this embodiment, and FIG. 12 is an axial cross-sectional view of the rotor 204 with the seal housing 210 omitted to illustrate features of the tangential-spring retraction assembly 306. In the leaf-spring retraction assembly 303 and the spring-bar retraction assembly 305 discussed above with reference to FIGS. 7 and 9, the leaf spring 340 or the spring bar 352 was oriented axially in the direction of the rotor 204. In this embodiment, a spring, referred to herein as a tangential spring 362, is oriented in a direction that is transverse to both the radial direction R and the axial direction A. A plurality of seal bodies 220 extends circumferentially around the rotor 204. In this embodiment, one tangential spring 362 is used for each seal body 220, and, thus, a plurality of tangential springs 362 is oriented circumferentially around the rotor 204. Each seal body 220 is suspended from a corresponding one of the tangential springs 362 by a linkage 364. Any suitable linkage may be used, including, for example, the linkage 342 or the segment plate 354 discussed above with reference to FIGS. 7 and 10, respectively. Alternatively, the linkage 364 may be a spring as well, such as a radial spring oriented in the radial direction R.

The tangential spring 362 spans a distance in the circumferential direction C around the rotor 204 and is attached to fixed anchors 366 that are circumferentially spaced around the rotor 204. The tangential spring 362 is attached to adjacent fixed anchors 366 to span the distance in the circumferential direction C around the rotor 204. In this embodiment, the fixed anchors 366 are each an axial bar or other suitable stay that is oriented in the axial direction A of the rotor 204 and attached to the seal housing 210. In this embodiment, the fixed anchors 366 are attached to the forward wall 214 and the aft wall 216 of the seal housing 210. The fixed anchors 366 of this embodiment are rigid, as least relative to the tangential spring 362, and the tangential spring 362 is used to impart the biasing force to the seal body 220 to move the seal body 220 in the retraction direction. As in the embodiments discussed above, a pneumatic force applied to the seal cavity 212 is used to move the seal body 220 in the extension direction.

FIGS. 13 to 16 show the rotor seal assembly 200 including a retraction assembly 307 according to another embodiment. For clarity with the other retraction assemblies discussed herein, the retraction assembly 307 of this embodiment will be referred to as a garter-spring retraction assembly 307. FIG. 13 is a schematic cross-sectional view of the rotor seal assembly 200 including the garter-spring retraction assembly 307 according to this embodiment, and FIGS. 14 to 16 are axial cross-sectional views of the rotor 204 with the seal housing 210 omitted to illustrate features of the garter-spring retraction assembly 307. FIG. 14 shows the anchor points of a first garter spring 371. FIG. 15 shows the anchor points of a second garter spring 373. FIG. 16 shows the anchor points of a third garter spring 375. In this embodiment, as in the embodiments discussed above, a pneumatic pressure within the seal cavity 212 is used to move the seal body 220 in the extension direction and at least one spring is connected to each of a plurality of seal bodies 220 to move each seal body 220 in the retraction direction. In this embodiment, a plurality of garter springs is used to impart the biasing force and move the seal body 220 in the retraction direction, a first garter spring 371, a second garter spring 373, and a third garter spring 375. Each of the first garter spring 371, the second garter spring 373, and the third garter spring 375 is placed at different axial positions around the plurality of seal bodies 220. One end of each of the first garter spring 371, the second garter spring 373, and the third garter spring 375 is attached, at a first anchor position 377, to the core casing 107. Each of the first garter spring 371, the second garter spring 373, and the third garter spring 375 extends circumferentially around each seal body 220 of the plurality of seal bodies 220, and the other end of each of the first garter spring 371, the second garter spring 373, and the third garter spring 375 is attached, at a second anchor position 379, to the core casing 107. The second anchor position 379 is a position on the core casing 107 that is different from the first anchor position 377. The tension and anchor positions (the first anchor position 377 and the second anchor position 379) are set to control and to provide the required stiffness characteristics for the seal body 220.

FIGS. 17 and 18 show a retraction assembly 308*a* for the rotor seal assembly 200 according to another embodiment. For clarity with the other retraction assemblies discussed herein, the retraction assembly 308*a* of this embodiment will be referred to as a circumferential-spring retraction assembly 308*a*. FIG. 17 is an axial view of the seal body 220 and the circumferential-spring retraction assembly 308*a*, and FIG. 18 is a cross-sectional view of the seal body 220 and the circumferential-spring retraction assembly 308*a* taken along line 18-18 in FIG. 17. Various details of the rotor seal assembly 200, such as the seal housing 210, are omitted to illustrate features of the circumferential-spring retraction assembly 308*a*. As noted above, a plurality of seal bodies 220 is arranged circumferentially around the rotor 204. In this embodiment, each seal body 220 is connected to an adjacent seal body 220 by one or more springs 382 located within a cavity 384 of the seal body 220. Any suitable spring may be used, such as helical springs. Each of the springs 382 imparts a biasing force to the seal bodies 220 to push the adjacent seal bodies 220 away from each other and, thus, move the seal body 220 in the retraction direction. A garter spring 386 may be used to help retain the seal bodies 220 and to limit the movement of the seal bodies 220 in the retraction direction. The garter spring 386 extends circumferentially around the plurality of seal bodies 220 and circumscribes the seal bodies 220. The garter spring 386 may provide a biasing force in the extension direction, but, as in the embodiments discussed above, the movement of the seal body 220 in the extension direction during operation may be driven by the pneumatic pressure within the seal cavity 212 against the biasing force imparted to each seal body 220 by the springs 382. This embodiment may be used with other embodiments discussed above, where the seal body 220 is suspended from the seal housing 210 by a retraction assembly 300.

FIG. 19A is an axial view of the seal body 220 and a retraction assembly 308*b* for the rotor seal assembly 200 according to another embodiment. The retraction assembly 308*b* of this embodiment is similar to the circumferential-spring retraction assembly 308*a* discussed above with reference to FIGS. 17 and 18, and, given the degree of similarity with the circumferential-spring retraction assembly 308*a*, the retraction assembly 308*b* of this embodiment also will be referred to as a circumferential-spring retraction assembly 308*b*. The same reference numerals will be used for components of the circumferential-spring retraction assembly 308*b* of this embodiment that are the same as or similar to the components of the circumferential-spring retraction assembly 308*a* discussed above. The description of these components above also applies to this embodiment, and a detailed description of these components is omitted here. In the embodiment shown in FIG. 17, the springs 382 are located on an outer circumferential portion of each seal body 220, but, in this embodiment, the springs 382 are located radially inward within each seal body 220. In this embodiment, each spring 382 is coiled around a protrusion 388 extending in the circumferential direction C from each of the seal bodies 220 and within the cavity 384.

FIG. 19B is an axial view of the seal body 220 and a retraction assembly 308*c* for the rotor seal assembly 200 according to another embodiment. The retraction assembly 308*c* of this embodiment is similar to the circumferential-spring retraction assemblies 308*a*, 308*b* discussed above with reference to FIGS. 17 and 19A, and, given the degree of similarity with the circumferential-spring retraction assemblies 308*a*, 308*b*, the retraction assembly 308*c* of this embodiment also will be referred to as a circumferential-spring retraction assembly 308*c*. The same reference numerals will be used for components of the circumferential-spring retraction assembly 308*c* of this embodiment that are the same as or similar to the components of the circumferential-spring retraction assembly 308*b* discussed above. The description of these components above also applies to this embodiment, and a detailed description of these components is omitted here. In the embodiment shown in FIG. 19A, the springs 382 are wrapped around a protrusion 388. In this embodiment, the protrusion 388 is omitted, and the position of the springs 382 within the cavity 384 is maintained by the force of the springs on the adjacent seal bodies 220.

FIG. 19C is an axial view of the seal body 220 and a retraction assembly 308*d* for the rotor seal assembly 200 according to another embodiment. The retraction assembly 308*d* of this embodiment is similar to the circumferential-spring retraction assemblies 308*a*, 308*b*, and 308*c* discussed above with reference to FIGS. 17 to 19B, and, given the degree of similarity with the circumferential-spring retraction assemblies 308*a*, 308*b*, and 308*c*, the retraction assembly 308*d* of this embodiment also will be referred to as a circumferential-spring retraction assembly 308*d*. The same reference numerals will be used for components of the circumferential-spring retraction assembly 308*d* of this embodiment that are the same as or similar to the components of the circumferential-spring retraction assemblies 308*a*, 308*b*, and 308*c* discussed above. The description of these components above also applies to this embodiment, and a detailed description of these components is omitted here. In the embodiments shown in FIGS. 17 to 19B, a single spring 382 imparting a biasing force in the circumferential direction C is positioned in each cavity 384. In this embodiment, however, multiple springs impart a biasing force in both the circumferential direction C and the radial direction R. In this embodiment, one seal body 220 includes one or more protrusions 392 that extend in the circumferential direction C into a corresponding cavity 394 formed in an adjacent seal body 220. A circumferential spring 396 is positioned at a distal end of the protrusion 392 to impart a biasing force in the circumferential direction C to the protrusion 392 and the wall of the cavity 394 to push the adjacent seal bodies 220 away from each other an in the retraction direction. Two radial springs 398 are oriented in the radial direction R to impart a biasing force to the protrusion in the radial direction R.

FIG. 20 is an axial view of the seal body 220 and a retraction assembly 308*e* for the rotor seal assembly 200 according to another embodiment. The retraction assembly 308*e* of this embodiment is similar to the circumferential-spring retraction assemblies 308*a*, 308*b*, 308*c*, and 308*d* discussed above with reference to FIGS. 17 to 19C, and, given the degree of similarity with the circumferential-spring retraction assemblies 308*a*, 308*b*, 308*c*, and 308*d* the retraction assembly 308*e* of this embodiment also will be referred to as a circumferential-spring retraction assembly 308*e*. The same reference numerals will be used for components of the circumferential-spring retraction assembly 308*e* of this embodiment that are the same as or similar to the components of the circumferential-spring retraction assemblies 308*a*, 308*b*, 308*c*, and 308*d* discussed above. The description of these components above also applies to this embodiment, and a detailed description of these components is omitted here. In the embodiments shown in FIGS. 17 to 19C, the pressure withing the seal cavity 212 is used to move the seal body 220 in the extension direction, but this embodiment includes a bellows 380 connected to each seal body 220. The bellows 380 of this embodiment may be arranged and operated similar to that of the bellows 334 discussed above with reference to FIGS. 5 and 6. The discussion of the bellows 334 also applies to this embodiment, and a detailed description the bellows 380 is, therefore, omitted here.

The discussion above uses the turbomachine 104 as an example of a rotary machine to which the rotor seal assembly 200 may be applied, but the rotor seal assembly 200 may be applied between any suitable stator 202 and rotor 204 in any suitable rotary machine. The rotor seal assembly 200 uses a non-contact hydrodynamic seal, and the retraction assembly 300 of the rotor seal assembly 200 retracts a seal body 220 from the rotor 204 to prevent contact when the hydrodynamic forces are not sufficient to maintain the non-contact hydrodynamic seal.

Further aspects of the present disclosure are provided by the subject matter of the following clauses.

A rotary machine comprises a rotor and a rotor seal assembly. The rotor is rotatable about a rotational axis and has a rotor seal face. The rotor seal assembly includes a seal body and a retraction assembly. The seal body has a seal face and is positionable to form a fluid-bearing gap between the seal face of the seal body and the rotor seal face. One or more primary fluid conduits are formed in the seal body, and the one or more primary fluid conduits are fluidly connected to the fluid-bearing gap to supply a fluid to the fluid-bearing gap. The retraction assembly is connected to the seal body to move the seal body in a retraction direction away from the rotor seal face.

The rotary machine of the preceding clause, the retraction assembly including one or more springs arranged to impart a biasing force to the seal body to move the seal body in the retraction direction.

The rotary machine of any preceding clause, at least one spring of the one or more springs being a thermally activated spring, the seal body being in a retracted position when the at thermally activated spring is at a first temperature and the seal body being in an extended position when the thermally activated spring is at a second temperature greater than the first temperature, and the seal face of the seal body being closer to the rotor seal face in the extended position than in the retracted position.

The rotary machine of any preceding clause, the thermally activated spring being formed from a shape memory alloy.

The rotary machine of any preceding clause, the thermally activated spring being formed from bimetallic materials.

The rotary machine of any preceding clause, further comprising a controller that is configured to control a temperature of the thermally activated spring.

The rotary machine of any preceding clause, the retraction assembly further including a spring housing having a cavity, the spring being positioned within the cavity of the spring housing, and the controller being configured to control the temperature of the cavity to control the temperature of the thermally activated spring.

The rotary machine of any preceding clause, further comprising a gap sensor configured to determine a distance between the rotor seal face and the seal face of the seal body, the controller being communicatively coupled to the gap sensor to receive gap information from the gap sensor and the controller is configured to adjust the temperature of the thermally activated spring based on the gap information received from the gap sensor.

The rotary machine of any preceding clause, further comprising an air source and a valve fluidly connected to the air source to control an airflow therefrom, the retraction assembly further including a spring housing having a cavity, the spring being positioned within the cavity of the spring housing and the spring housing being fluidly coupled to the air source, and the controller being operatively coupled to the valve to adjust the flow of air into the cavity to control the temperature of the thermally activated spring.

The rotary machine of any preceding clause, the rotor including a radial direction, and the retraction assembly includes a helical spring having an axial direction, the axial direction of the helical spring aligned with the radial direction to impart a biasing force to the seal body to move the seal body in the radial direction of the rotor, the radial direction of the rotor being the retraction direction.

The rotary machine of any preceding clause, the retraction assembly further including a bellows having a cavity formed therein, the bellows being connected to the seal body such that, when a pneumatic load is applied to the cavity of the bellows, the seal body moves in an extension direction, the extension direction being a direction towards the rotor seal face.

The rotary machine of any preceding clause, the helical spring being located within the cavity of the bellows.

The rotary machine of any preceding clause, further comprising a plurality of helical springs located within the cavity of the bellows.

The rotary machine of any preceding clause, the rotor including a radial direction and an axial direction parallel to the rotational axis of the rotor, the radial direction of the rotor being the retraction direction and the retraction assembly including a spring having a longitudinal direction, the longitudinal direction of the spring being parallel to the axial direction of the rotor, the spring imparting a biasing force to the seal body to move the seal body in the radial direction of the rotor.

The rotary machine of any preceding clause, the spring being a leaf spring.

The rotary machine of any preceding clause, the leaf spring having an arcuate shape.

The rotary machine of any preceding clause, the leaf spring being directly connected to the seal body.

The rotary machine of any preceding clause, the seal body being connected to the spring by a linkage such that the seal body is suspended from the spring.

The rotary machine of any preceding clause, one end of the linkage being attached to a sleeve, and the sleeve surrounds the spring.

The rotary machine of any preceding clause, the sleeve being movable axially along the longitudinal direction of the spring.

The rotary machine of any preceding clause, the spring being a spring bar.

The rotary machine of any preceding clause, the seal body being connected to and suspended from the spring bar by a segment plate.

The rotary machine of any preceding clause, the segment plate containing a hole and the spring bar extends through the hole of the segment plate.

The rotary machine of any preceding clause, the hole having a clearance around the spring bar, and the clearance of the hole is large enough to allow the segment plate to move both radially and axially.

The rotary machine of any preceding clause, the retraction assembly including a first spring and a second spring connected to each other.

The rotary machine of any preceding clause, the first spring imparting a first biasing force to the seal body in a first direction, and the second spring imparting a second biasing force to the first spring in a second direction, the second direction being transverse to the first biasing force imparted by the first spring.

The rotary machine of any preceding clause, the rotor including a radial direction and an axial direction parallel to the rotational axis of the rotor, and the first direction being in the radial direction of the rotor and the second direction is in the axial direction of the rotor.

The rotary machine of any preceding clause, the second spring being a helical spring.

The rotary machine of any preceding clause, the first spring being a leaf spring.

The rotary machine of any preceding clause, the rotor including a radial direction and an axial direction parallel to the rotational axis of the rotor, and the retraction assembly including a spring having a longitudinal direction, the longitudinal direction of the spring being a direction that is transverse to both the radial direction and the axial direction, the spring imparting a biasing force to the seal body to move the seal body in the radial direction of the rotor, the radial direction of the rotor being the retraction direction.

The rotary machine of any preceding clause, the seal body being connected to the spring by a linkage such that the seal body is suspended from the spring.

The rotary machine of any preceding clause, the linkage being a spring oriented in the radial direction.

The rotary machine of any preceding clause, the rotor seal assembly including a plurality of seal bodies arranged circumferentially around the rotor.

The rotary machine of any preceding clause, the rotor including a radial direction, an axial direction parallel to the rotational axis of the rotor, and a circumferential direction, and the retraction assembly including a plurality of fixed anchors arranged circumferentially around the rotor and a spring connected to adjacent fixed anchors to span a distance in the circumferential direction around the rotor, the spring imparting a biasing force to the seal body to move the seal body in the radial direction of the rotor, the radial direction of the rotor being the retraction direction.

The rotary machine of any preceding clause, the plurality of seal bodies circumscribing the rotor with one seal body being adjacent to two other seal bodies.

The rotary machine of any preceding clause, the rotor including a radial direction and an axial direction parallel to the rotational axis of the rotor, and the retraction assembly including a plurality of garter springs, each garter spring of the plurality of garter springs extending circumferentially around each seal body of the plurality of seal bodies.

The rotary machine of any preceding clause, each garter spring of the plurality of garter springs extending circumferentially around each seal body of the plurality of seal bodies at a different axial location.

The rotary machine of any preceding clause, each seal body of the plurality of seal bodies being connected to an adjacent seal body by one or more springs.

The rotary machine of any preceding clause, each of the springs imparting a biasing force to the seal bodies to push the adjacent seal bodies away from each other and to move the seal body in the retraction direction.

The rotary machine of any preceding clause, a garter spring extending circumferentially around the plurality of seal bodies and circumscribes the seal bodies.

The rotary machine of any preceding clause, further comprising a plurality of bellows, each bellow of the plurality of bellows having a cavity therein and being connected to a seal body of the plurality of seal bodies such that, when a pneumatic load is applied to the cavity of the bellows, the seal body moves in an extension direction, the extension direction being a direction towards the rotor seal face.

The rotary machine of any preceding clause, the rotor seal assembly further including a seal housing with a seal cavity defined therein, the seal body located within the seal cavity of the seal housing.

The rotary machine of any preceding clause, the one or more primary fluid conduits fluidly connecting the seal cavity to the fluid-bearing gap.

The rotary machine of any preceding clause, the seal body being movable in an extension direction when a pneumatic load is applied to the seal cavity, the extension direction being a direction towards the rotor seal face.

The rotary machine of any preceding clause, the rotor seal assembly separating an inlet plenum from an outlet plenum, a fluid in the inlet plenum having a higher pressure than a fluid in the outlet plenum, the seal cavity of the seal housing being fluidly connected to the inlet plenum by one or more inlet apertures.

A gas turbine engine comprising the rotary machine of any preceding clause.

The gas turbine engine of any preceding clause, the rotary machine being a turbomachine.

The gas turbine engine of any preceding clause, the turbomachine including a set of rotating blades that rotate relative to a corresponding set of static vanes, the set of rotating blades being connected to a shaft, the shaft being the rotor.

The gas turbine engine of any preceding clause, the rotor seal assembly being positioned between the set of static vanes and the shaft.

The gas turbine engine of any preceding clause, the turbomachine including a turbine having a least one stage including the set of rotating blades and the set of static vanes.

Although the foregoing description is directed to the preferred embodiments, other variations and modifications will be apparent to those skilled in the art, and may be made without departing from the spirit or the scope of the disclosure. Moreover, features described in connection with one embodiment may be used in conjunction with other embodiments, even if not explicitly stated above.

The invention claimed is:

1. A gas turbine engine comprising:

a rotary machine, the rotary machine being a turbomachine and including:

a set of rotating blades that rotate relative to a corresponding set of static vanes, the set of rotating blades being connected to a shaft, the shaft being a rotor, the rotor rotatable about a rotational axis and having a rotor seal face; and a rotor seal assembly including:

a seal body having a seal face, the seal body being positionable to form a fluid-bearing gap between the seal face of the seal body and the rotor seal face;

one or more primary fluid conduits formed in the seal body, the one or more primary fluid conduits fluidly connected to the fluid-bearing gap to supply a fluid to the fluid-bearing gap; and a retraction assembly connected to the seal body to move the seal body in a retraction direction away from the rotor seal face.

2. The rotary machine of claim 1, wherein the retraction assembly includes one or more springs arranged to impart a biasing force to the seal body to move the seal body in the retraction direction.

3. The rotary machine of claim 2, wherein at least one spring of the one or more springs is a thermally activated spring, the seal body being in a retracted position when the thermally activated spring is at a first temperature and the seal body being in an extended position when the thermally activated spring is at a second temperature greater than the first temperature, the seal face of the seal body being closer to the rotor seal face in the extended position than in the retracted position.

4. The rotary machine of claim 3, further comprising a controller that is configured to control a temperature of the thermally activated spring.

5. The rotary machine of claim 1, wherein the rotor includes a radial direction, and the retraction assembly includes a helical spring having an axial direction, the axial direction of the helical spring aligned with the radial direction to impart a biasing force to the seal body to move the seal body in the radial direction of the rotor, the radial direction of the rotor being the retraction direction.

6. The rotary machine of claim 5, wherein the retraction assembly further includes a bellows having a cavity formed therein, the bellows being connected to the seal body such that, when a pneumatic load is applied to the cavity of the bellows, the seal body moves in an extension direction, the extension direction being a direction towards the rotor seal face.

7. The rotary machine of claim 1, wherein the rotor includes a radial direction and an axial direction parallel to the rotational axis of the rotor, the radial direction of the rotor being the retraction direction, and wherein the retraction assembly includes a spring having a longitudinal direction, the longitudinal direction of the spring being parallel to the axial direction of the rotor, the spring imparting a biasing force to the seal body to move the seal body in the radial direction of the rotor.

8. The rotary machine of claim 7, wherein the spring is a leaf spring.

9. The rotary machine of claim 8, wherein the leaf spring has an arcuate shape.

10. The rotary machine of claim 7, wherein the seal body is connected to the spring by a linkage such that the seal body is suspended from the spring.

11. The rotary machine of claim 10, wherein one end of the linkage is attached to a sleeve, the sleeve being movable axially along the longitudinal direction of the spring.

12. The rotary machine of claim 7, wherein the spring is a spring bar, the seal body being connected to and suspended from the spring bar by a segment plate.

13. The rotary machine of claim 12, wherein the segment plate contains a hole and the spring bar extends through the hole of the segment plate, the hole having a clearance around the spring bar, the clearance of the hole being large enough to allow the segment plate to move both radially and axially.

14. The rotary machine of claim 1, wherein the retraction assembly includes a first spring and a second spring connected to each other.

15. The rotary machine of claim 14, wherein the first spring imparts a first biasing force to the seal body in a first direction, and wherein the second spring imparts a second biasing force to the first spring in a second direction, the second direction being transverse to the first biasing force imparted by the first spring.

16. The rotary machine of claim 1, wherein the rotor seal assembly includes a plurality of seal bodies arranged circumferentially around the rotor.

17. The rotary machine of claim 16, wherein the rotor includes a radial direction, an axial direction parallel to the rotational axis of the rotor, and a circumferential direction, and wherein the retraction assembly includes:

a plurality of fixed anchors arranged circumferentially around the rotor; and a spring connected to adjacent fixed anchors to span a distance in the circumferential direction around the rotor, the spring imparting a biasing force to a corresponding seal body of the plurality of seal bodies to move the corresponding seal body in the radial direction of the rotor the radial direction of the rotor being the retraction direction.

18. The rotary machine of claim 16, wherein the rotor includes a radial direction and an axial direction parallel to the rotational axis of the rotor, and wherein the retraction assembly includes a plurality of garter springs, each garter spring of the plurality of garter springs extending circumferentially around each seal body of the plurality of seal bodies.

19. The rotary machine of claim 16, wherein the plurality of seal bodies circumscribes the rotor with one seal body being adjacent to two other seal bodies, and wherein each seal body of the plurality of seal bodies is connected to an adjacent seal body by one or more springs.

20. A rotary machine comprising:

a rotor rotatable about a rotational axis and having a rotor seal face; and a rotor seal assembly including:

a seal body having a seal face, the seal body being positionable to form a fluid-bearing gap between the seal face of the seal body and the rotor seal face;

one or more primary fluid conduits formed in the seal body, the one or more primary fluid conduits fluidly connected to the fluid-bearing gap to supply a fluid to the fluid-bearing gap; and a retraction assembly connected to the seal body to move the seal body in a retraction direction away from the rotor seal face, wherein the retraction assembly includes one or more springs arranged to impart a biasing force to the seal body to move the seal body in the retraction direction, and wherein at least one spring of the one or more springs is a thermally activated spring, the seal body being in a retracted position when the thermally activated spring is at a first temperature and the seal body being in an extended position when the thermally activated spring is at a second temperature greater than the first temperature, the seal face of the seal body being closer to the rotor seal face in the extended position than in the retracted position.

* * * * *